US008984849B1

(12) United States Patent
Cohen

(10) Patent No.: US 8,984,849 B1
(45) Date of Patent: Mar. 24, 2015

(54) EQUESTRIAN STIRRUP IRON

(71) Applicant: Martin D. Cohen, Seaside, CA (US)

(72) Inventor: Martin D. Cohen, Seaside, CA (US)

( * ) Notice: Subject to any disclaimer, the term of this patent is extended or adjusted under 35 U.S.C. 154(b) by 0 days.

(21) Appl. No.: 14/074,504

(22) Filed: Nov. 7, 2013

Related U.S. Application Data

(63) Continuation-in-part of application No. 29/458,205, filed on Jun. 17, 2013, now Pat. No. Des. 710,551.

(51) Int. Cl.
*B68C 3/00* (2006.01)

(52) U.S. Cl.
CPC ..... *B68C 3/00* (2013.01)
USPC ..... 54/49; 54/47

(58) Field of Classification Search
CPC ..... B68C 1/16; B68C 3/00; B68C 3/0016; B68C 3/02; B68C 3/025; B68C 2003/00; B68C 2003/025; B68C 2003/0083; B68C 2003/0091
USPC ..... 54/46.1, 47, 49, 49.5, 48
See application file for complete search history.

(56) References Cited

U.S. PATENT DOCUMENTS

| | | | | |
|---|---|---|---|---|
| 169,209 | A | 9/1875 | Wagstaff | |
| 606,368 | A * | 6/1898 | Thorn | 54/49 |
| 608,605 | A | 8/1898 | House | |
| 706,468 | A | 8/1902 | Wellman | |
| 746,126 | A | 12/1903 | Myers | |
| D47,024 | S | 3/1915 | Buermann | |
| 1,174,712 | A | 3/1916 | Gunn | |
| 1,639,073 | A | 8/1927 | Berbaum | |
| 2,532,082 | A | 11/1950 | Borst | |
| D222,556 | S | 11/1971 | Whitman | |
| 3,816,974 | A | 6/1974 | Erickson | |
| 3,927,509 | A | 12/1975 | Riebold | |
| D292,628 | S | 11/1987 | Racina | |
| D318,936 | S | 8/1991 | Rabeck | |
| 5,172,538 | A | 12/1992 | Luger | |
| D339,665 | S | 9/1993 | Nishimoula | |
| D370,091 | S | 5/1996 | Simmons | |
| 5,598,687 | A | 2/1997 | Hester | |
| D383,572 | S | 9/1997 | Rea | |
| D394,524 | S | 5/1998 | Cohen | |
| D394,525 | S | 5/1998 | Simmons | |
| 5,794,419 | A | 8/1998 | Cohen | |
| D411,667 | S | 6/1999 | Martin | |

(Continued)

FOREIGN PATENT DOCUMENTS

| | | | | |
|---|---|---|---|---|
| WO | WO 2007052127 A1 * | 5/2007 | | B68C 3/00 |
| WO | WO 2007107436 A1 * | 9/2007 | | B68C 3/00 |

OTHER PUBLICATIONS

English-language translation of WO 2007/107436 A1.*

*Primary Examiner* — Peter M Poon
*Assistant Examiner* — Lisa Tsang
(74) *Attorney, Agent, or Firm* — Aka Chan LLP

(57) ABSTRACT

A stirrup includes a stirrup leather opening and a foot opening. Above the stirrup leather opening is a top member that includes a number of bends. A first bend is in a first direction, a second bend is in a second direction, opposite to the first direction, a third bend is a first direction, and a fourth bend is in the second direction. The bends in the top member will orient the stirrup iron at an angle relative to the horse, rather than parallel to the side of a horse as in a typical straight or flat stirrup. The stirrup is more stable, reduces pain and stress in the leg, is easier to retrieve, and is safer than conventional stirrups.

20 Claims, 36 Drawing Sheets

(56) References Cited

U.S. PATENT DOCUMENTS

| | | | | |
|---|---|---|---|---|
| D415,594 | S | 10/1999 | Bostock | |
| D415,862 | S | 10/1999 | Bostock | |
| D417,038 | S | 11/1999 | Bostock | |
| D429,389 | S | 8/2000 | Bostock | |
| D458,420 | S | 6/2002 | Abady | |
| D461,602 | S | 8/2002 | Abady | |
| 6,513,309 | B1 * | 2/2003 | Morgante | 54/47 |
| D491,698 | S | 6/2004 | Zucchini | |
| D509,630 | S | 9/2005 | Bunjes | |
| D518,246 | S | 3/2006 | Bunjes | |
| D568,549 | S | 5/2008 | Augsten | |
| 7,469,523 | B2 * | 12/2008 | Hussey | 54/47 |
| D593,261 | S | 5/2009 | Nishimura | |
| D608,955 | S | 1/2010 | Baumann et al. | |
| 7,934,363 | B2 * | 5/2011 | Vollmecke et al. | 54/48 |
| D644,028 | S | 8/2011 | Boas et al. | |
| D644,029 | S | 8/2011 | Boas et al. | |
| D679,060 | S | 3/2013 | Bates | |
| 2006/0168919 | A1 * | 8/2006 | Strauss | 54/48 |
| 2009/0178375 | A1 * | 7/2009 | Benetti | 54/49 |

* cited by examiner

EQUESTRIAN STIRRUP IRON

CROSS-REFERENCE TO RELATED APPLICATION

This application is a continuation-in-part of U.S. patent application Ser. No. 29/458,205, filed Jun. 17, 2013, which is incorporated by reference along with all other references cited in this application.

BACKGROUND OF THE INVENTION

The present invention relates to an improved stirrup iron for equestrian use which can be oriented so that the rider can select a number of varying angles that allow the rider to engage the stirrup iron in its most comfortable and accessible manner, thus providing an improved utilization of the stirrup iron for the rider's particular riding style, personal conformation, and safety.

When horses began to be used for domestic purposes, they were first employed for draft. However, it soon became apparent that horses could be utilized for riding. The saddle was developed and evolved from at least as early as 2000 BC. In order to enhance control of the horse, the saddles were developed with a wooden internal frame or tree. This gives shape to the seat as well as generally defines the underside contact of the saddle on the horse's back. The saddle tree is padded and covered. The greatest advance in security of rider on horse was the invention of the stirrup, which came into evidence about AD 550. The original stirrup was a looped leather strap which was attached to the saddle tree. The lower opening of the loop received the foot. There are many advantages to the use of the stirrup, most of which relate to the comfort and security of the rider.

The stirrup iron was soon developed. The stirrup iron is a generally D-shaped structure with a foot opening which the rider's foot is placed through. Above the foot opening is an elongated opening for receiving a stirrup strap or leather. In regard to terminology, "stirrup leather" is a generally accepted term in the equestrian community. The meaning of the term is a leather strap which connects the stirrup iron to the saddle at a stirrup bar. It will be understood that the upper end of the stirrup leather connects to the stirrup bar, while the lower end of the stirrup leather passes through the elongated opening to support the stirrup iron. The stirrup bar is integrated into the saddle itself, and is generally affixed to the saddle slightly behind and below the saddle's pommel. The stirrup bar is oriented generally fore and aft with respect to the saddle and, thus, the stirrup leather lies against the saddle flap with the width direction of the leather being oriented generally fore and aft with respect to the saddle.

When the horse is not being ridden, the stirrup iron is normally in a resting or "run up" position. In preparation for riding, the stirrup iron is brought down from the run up position, and the stirrup iron hangs at the end of the stirrup leather with an orientation parallel to the horse. This is not the position the rider needs to ride the horse. The rider requires that the stirrup iron be turned at an angle to meet riding style needs, comfort needs, and a certain amount of safety.

Thus, there is a need for a stirrup iron that is angled or provides a variety of angles to fulfill the immediate need of the equestrian to have the stirrup irons into a more forward position. Should the rider accidentally lose the stirrup position, and the rider's foot becomes disengaged from the stirrup, it would be desirable for the stirrup iron to retain its angled positioning so that it can be easily and predictably positioned for the rider's retrieval of the stirrup iron.

BRIEF SUMMARY OF THE INVENTION

A stirrup includes a stirrup leather opening and a foot opening. Above the stirrup leather opening is a top member that includes a number of bends. A first bend is in a first direction, a second bend is in a second direction, opposite to the first direction, a third bend is a first direction, and a fourth bend is in the second direction. The bends in the top member will orient the stirrup iron at an angle relative to the horse, rather than parallel to the side of a horse as in a typical straight or flat stirrup. The stirrup is more stable, reduces pain and stress in the leg, is easier to retrieve, and is safer than conventional stirrups.

The present invention provides a solution to fulfill that need with a modified stirrup iron. Instead of the elongated opening through which the stirrup leather passes, the opening of the present invention incorporates an angled portion that allows the stirrup to hang at an angle that is comfortable for the rider. U.S. Pat. Nos. 5,794,419 and D394,524 describe a stirrup with a pivot or swivel assembly and are incorporated by reference.

For further ease in slipping the rider's foot into position in the stirrup, the bottom of the stirrup iron contains an angled foot plate. It is an object of the present invention, therefore, to provide an improvement in the rider's foot position, and to provide enhanced personal comfort and safety while maintaining the rider's feet in the stirrup irons.

The stirrup described in this patent provides: (1) more stable platform for the rider's foot and overall base of support; (2) relief of pressure on the rider's joints (ankle, knee, and hip); (3) reduction in leather pressure on the front of the shin; (4) improvement in the retrieval of a lost stirrup; and (5) reduction of the tendency of the stirrup to turn back to the horse's side and potentially catching a falling rider's foot and being drug. The stirrup is more stable, reduces pain and stress in the leg, is easier to retrieve, and is safer than conventional stirrups.

In an implementation, an apparatus includes: a first side member and a second side member, opposite to the first side member; a foot bar, connecting first ends of the first and second side members together; a middle member, connecting second ends of the first and second side members together, where the middle member is opposite to the foot bar; and a top member, connecting opposite ends of the middle member and second ends of the first and second side members, where the middle member is opposite to the foot bar and the middle member is between the top member and foot bar. The first and second side members, foot bar, and middle member define a first opening sufficiently sized to accept a foot. The middle member and top member define a second opening, smaller than the first opening, sufficiently sized to accept a stirrup leather. The top member includes a first bend in a first direction, a second bend in a second direction, opposite to the first direction, a third bend in a first direction, and a fourth bend in the second direction.

In various implementations, the first bend in the first direction includes a first angle away from a plane formed by the first and second side members. The second bend in the second direction includes a second angle toward the plane formed by the first and second side members. The third bend in the first direction includes a third angle toward the plane formed by the first and second side members, and the first angle is equal to the third angle, but in opposite directions. The fourth bend in the second direction includes a fourth angle toward the plane formed by the first and second side members, and the fourth angle is equal to the first angle, but in opposite directions.

A segment of the top member, between the second and third bends, passes through the plane formed by the first and second side members. The top member includes a first segment from the first bend to the second bend, a second segment from the second bend to the third bend, and a third segment from the third bend to the fourth bend; a first distance is from the first bend to the fourth bend; a second distance comprises a sum of lengths of the first segment, second segment, and third segment; and the second distance is greater than the first distance.

An area of the first opening is greater than an area of the second opening. The apparatus can include: a foot pad, connected to the foot bar, where a top surface of the foot pad is textured and faces the middle member. The apparatus can include a foot pad, connected to the foot bar, where first and second portions of a top surface of the foot pad are textured, the first portion faces the middle member, and the second portion is angled relative to the first potion.

A section of the top member, between the second and third bends, is angled relative to the foot bar at about 45 degrees. A section of the top member, between the second and third bends, is angled relative to the foot bar at an angle in a range between about 40 degrees to about 50 degrees.

In an implementation, a method includes: providing an equestrian stirrup including a top member and a foot bar member, where the top and foot bar members are connected together; forming a first portion of the top member of the stirrup to be parallel to the foot bar; and forming a second portion of the top member of the stirrup to be angled at a first angle relative to the foot bar. The first angle can be in a range between about 40 degrees to about 50 degrees.

The equestrian stirrup includes a middle member, the middle member is connected to the top and foot bar members, and the middle member is between the top and foot bar members, and the second portion of the top member of the stirrup is angled at the first angle relative to the middle member, and between the top and middle members is a stirrup leather opening.

The method includes: providing a first removable member for the top member, where the first removable member can be removably connected to the top member, and the first removable member includes the second portion of the top member having the first angle.

The method includes: providing a second removable member for the top member, where the second removable member can be removably connected to the top member, and the second removable member includes a second angle relative to the foot bar that is different form the first angle; allowing the first removable member for the top member to be removed from the stirrup and replaced by the second removable member, thus altering a riding angle for the stirrup.

In an implementation, a kit includes: a packaging for the kit including: an equestrian stirrup including a top member, middle member, and a foot bar member, where the top, middle, and foot bar members are connected together, where the top member includes a first removable section. The first removable section is capable of being connected to the top member of the equestrian stirrup, where the first removable section is angled relative to the middle member at a first angle. A second removable section is capable of being connected to the top member of the equestrian stirrup, where the second removable section is angled relative to the middle member at a second angle, different from the first angle.

The middle member is between a first and second opening of the equestrian stirrup. The kit can include a textured foot pad, coupled to the foot bar member.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
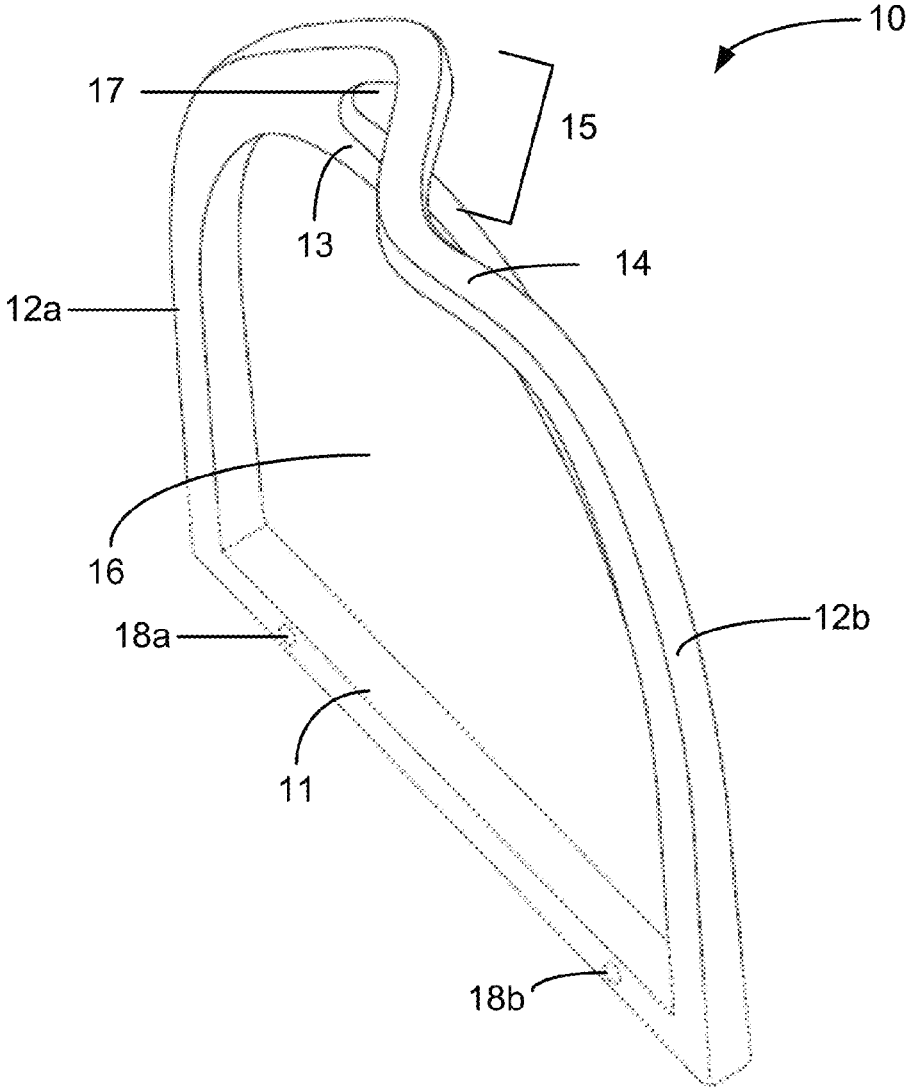
FIG. 1 shows a perspective view of a first embodiment of a design of a stirrup.

FIGS. 1-5 show an improved stirrup iron 10 of this invention. The stirrup iron 10 includes a foot bar 11, two side members 12*a* and 12*b*, a middle member 13, and a top member 14, which includes an angled portion 15. The stirrup has a first opening 16, for the rider's foot, and a second opening 17 for the stirrup leather, which is attached to the saddle.

FIGS. 1-5 show a stirrup for one side of a pair of stirrups. In an implementation, the stirrup is for a right foot on a right side of the horse. For a left foot on a left side of the horse, a stirrup that is a mirror image of this stirrup is used. In an implementation, the stirrup is for the left foot on the left side of the horse. For the right foot on the right side of the horse, a stirrup that is a mirror image of this stirrup is used. A kit including a pair of stirrups includes right left stirrups.

In an implementation, the stirrup in FIGS. 1-5 is used for both left and right sides of the horse. In an implementation, the stirrup that is a mirror image (i.e., about a vertical axis through a middle of the stirrup) of the stirrup in FIGS. 1-5 is used for both left and right sides of the horse. The stirrup includes first side member 12*a* and a second side member 12*b*, opposite to the first side member. Foot bar 11 connects first ends of the first and second side members together. Middle member 13 connects second ends, opposite to the first ends, of the first and second side members together. The middle member is opposite to the foot bar.

The stirrup includes top member 14, connecting opposite ends of the middle member and second ends of the first and second side members. The middle member is between the top member and foot bar. The top member connects to opposite ends of the middle member and the second ends of the first and second side members.

A perimeter of first opening 16 is bounded by the first and second side members, foot bar, and middle member. The first opening is appropriately and sufficiently sized to accept the foot of a rider (e.g., human shoe sizes 6-15). Typically, a length (horizontal direction) of the first opening is longer than a width (vertical direction) of the first opening. The first opening may be referred to as a foot opening.

A perimeter of second opening 17 is bounded by the middle member and the top member. The second opening is smaller than the first opening, appropriately and sufficiently sized to accept a stirrup leather from the saddle to hold the stirrup. The second opening may be referred to as a stirrup leather opening.

An area of the second opening is less than an area of the first opening. Further a length (horizontal direction) of the second opening is less than a length of the first opening. A width (vertical direction) of the second opening is less than a width of the first opening. Typically, a length (horizontal direction) of the second opening is less than a width (vertical direction) of the first opening. The stirrup strap is typically leather and is wider than its thickness, so the second opening accommodates this.

Figure 2:
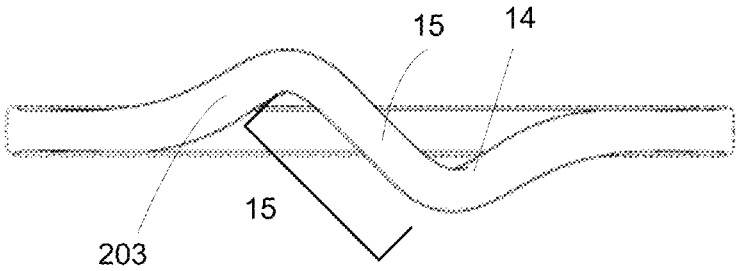
FIG. 2 shows a top view of FIG. 1.
Figure 3:
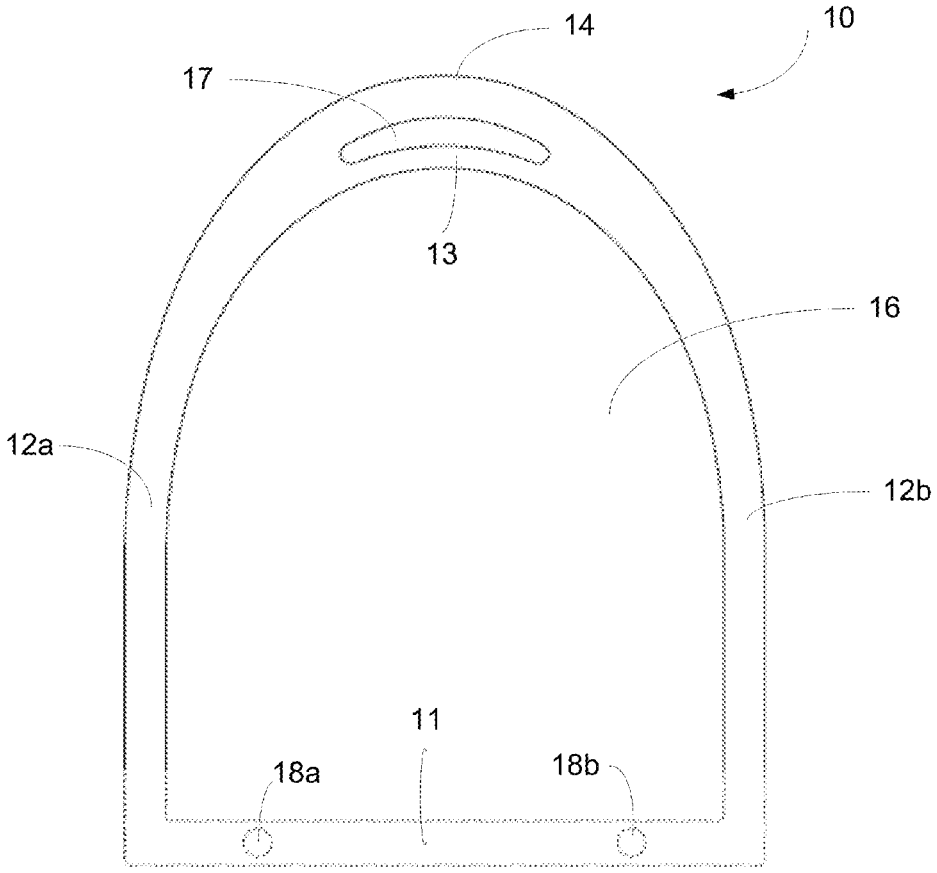
FIG. 3 shows a front view of FIG. 1. A back view appears the same as the front view.

Referring to FIG. 2, top member 14 includes (a) from left to right, a first bend 203 in a first direction, (b) a second bend 15 in a second direction, opposite of the first direction, (c) a third bend in the first direction, and (d) a fourth bend in the second direction. The first direction is counterclockwise to the direction of the top member from left to right, while the second direction is clockwise.

The first side member 12*a* is opposite to the second side member 12*b*. The foot bar couples a first end of the first member 12*a* and a first end of the second member 12*b* together. The middle member 13 couples a second end of the first member 12*a* and a second end of the second member 12*b* together. The middle member 13 is opposite to the foot bar 11.

In use, the rider places the foot through the stirrup's first opening. A bottom of the rider's shoe can rest or push against the top of the foot bar. In alternative embodiments, the stirrup can include a foot pad to provide a wider platform for the rider's shoe. This foot pad or foot rest can be textured to give more grip for the rider's shoe, to prevent slipping. The foot rest can be attached via holes or openings 18*a* and 18*b* (see FIG. 3) using a bolt or other fastener. Further discussion of various foot pads is below. In embodiments without an additional foot rest, the holes can be omitted.

Figure 4:
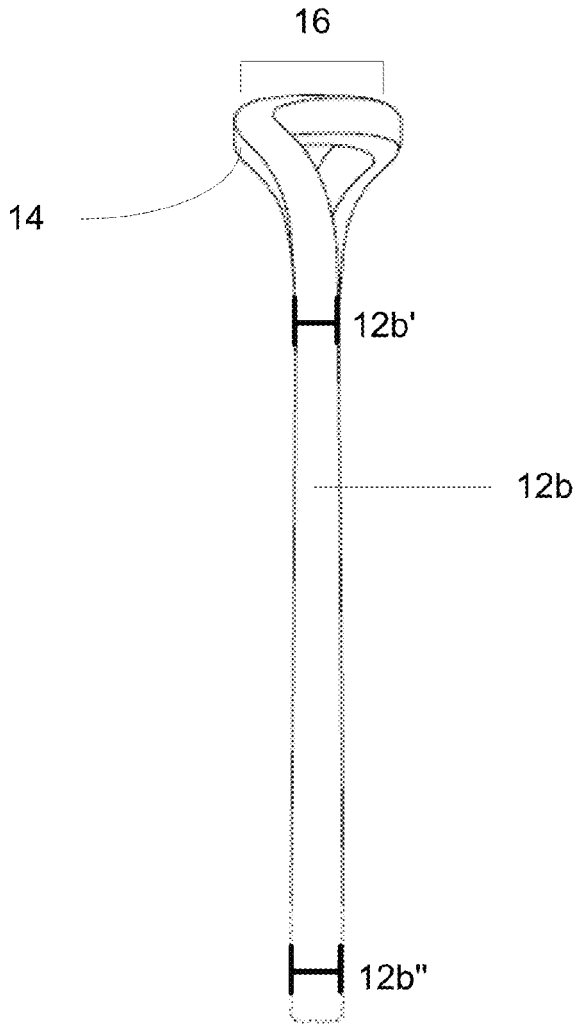
FIG. 4 shows a right-side view of FIG. 1. A left-side view appears the same as the right-side view.

FIG. 4 shows tapering of second member 12*b*. A thickness 12*b*', closer to a top of the stirrup, is thinner than a thickness 12*b*", which is near a bottom of the stirrup. First member 12*a* is tapered similarly.

Figure 5:
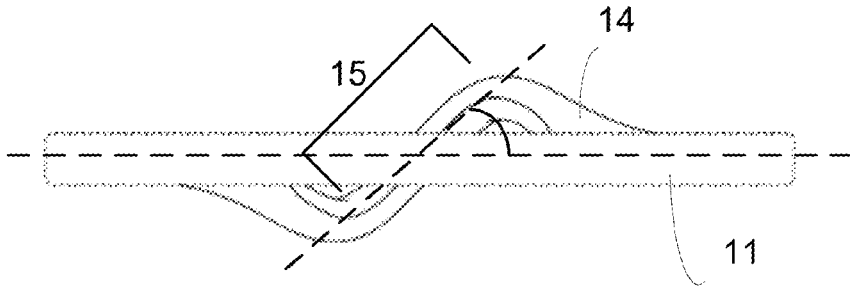
FIG. 5 shows a bottom view of FIG. 1.

FIG. 5 shows that second bend 15 of the top member 14 is angled with respect to foot bar 11.

Figure 6A:
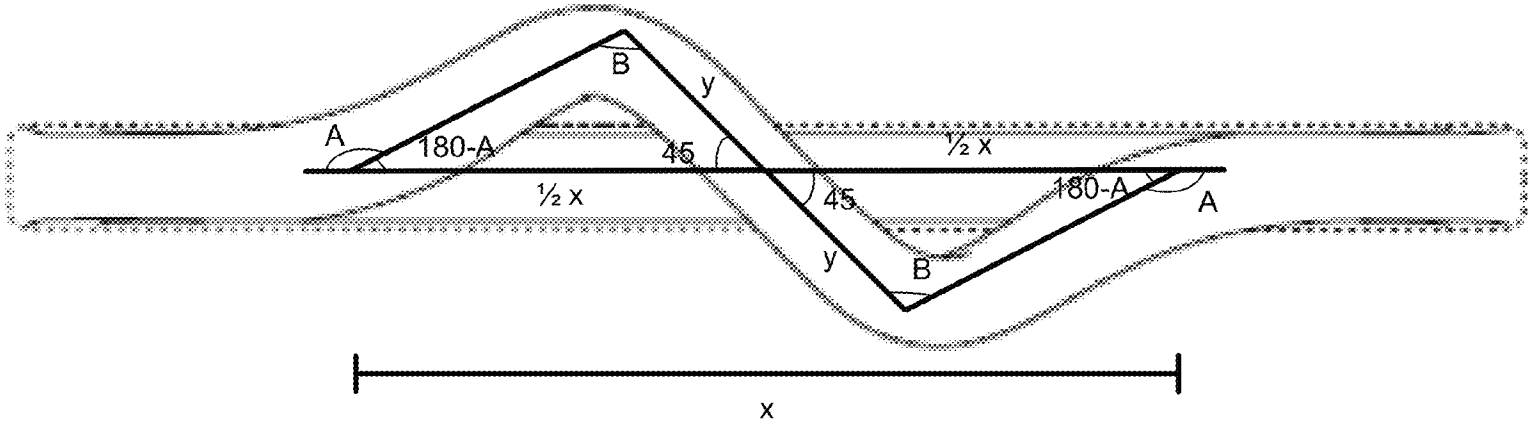
FIG. 6A shows a top view of a stirrup and the angles and lengths of sections or segments of the top member.

FIG. 6A shows angles of a symmetrical top member 14. There are two triangles in opposite directions from a horizontal line (that is parallel with foot bar 11). These triangles extend a length x. For the first triangle (from left to right), and the first bend 203 is at an angle A with respect to the horizontal. Second bend 15 is at an angle B with respect to segment 203. The angle formed by at an intersection of bend 15 and the horizontal is 45 degrees. The triangle has three angles, 180-A, B, and 45, which add up to 180 degrees. A length of bend 15 to the intersection is y, and a total length of bend 15 is 2y. A length from vertex A to the intersection is x/2. The second triangle (from left to right) after the intersection is similar to the first triangle.

FIG. 6A shows a symmetrical top member, but in other implementations, the top member need not be symmetrical. For an asymmetrical top member, the two triangles will be dissimilar to each other.

Figure 6B:
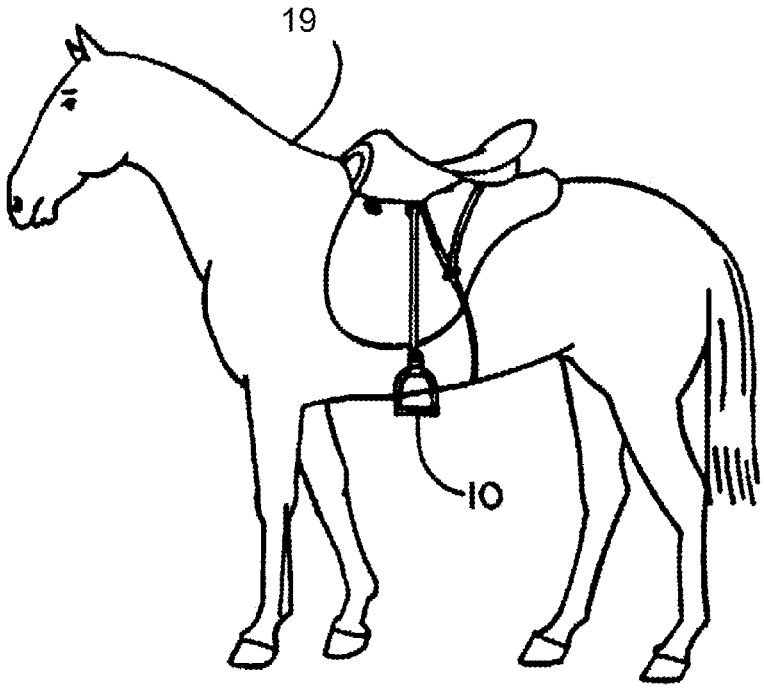
FIG. 6B shows a view of a stirrup that hangs at an orientation parallel to the horse.

To use the stirrup, the rider attaches the stirrup to the saddle by looping the stirrup leather of the saddle through the second opening. The second opening is smaller than the first opening or an area of the first opening is greater than an area of the second opening. For a stirrup without an angled portion 15 in the top bar, the top bar is parallel to the foot bar, and the stirrup iron hangs at the end of the stirrup leather with an orientation parallel to the horse. See FIG. 6B which shows a horse with stirrup in orientation parallel to the horse. But this is not the position the rider needs to ride the horse.

The top member has a first bend in a first direction, a second bend in a second direction, opposite to the first direction, a third bend in a first direction, a fourth bend in the second direction. The first bend in the first direction is at a first angle away from a plane formed by the first and second side members, 12*a* and 12*b*. The second bend in the second direction is at a second angle toward the plane formed by the first and second side member, 12*a* and 12*b*. The third bend in the first direction is at a third angle toward the plane formed by the first and second side members. The first angle is equal to the third angle, but in opposite directions. The fourth bend in the second direction is at a fourth angle toward the plane formed by the first and second side members, 12*a* and 12*b*. The fourth angle is equal to the first angle, but in opposite directions. A segment of the top member, between the second and third bends, passes through the plane formed by the first and second side members, 12*a* and 12*b*.

The top member has a first segment from the first bend to the second bend, a second segment from the second bend to the third bend, and a third segment from the third bend to the fourth bend. A first distance is from the first bend to the fourth bend. A second distance is a sum of lengths of the first segment, second segment, and third segment. And the second distance is greater than the first distance.

In other implementations, a segment or section o the top member, between the second and third bends, is angled relative to the foot bar in a range between about 40 degrees to about 50 degrees, such as 40, 41, 42, 43, 44, 45, 46, 47, 48, 49, 50 degrees, and others.

In FIGS. 1-5, the top bar includes angled portion 15. The angle shown in FIG. 1 is about 43 degrees. This angle can be measured relative to the foot bar. This angle is also a relative angle offset from the foot bar, ranging from 0 degrees to 180 degrees. More specifically, the angle is between a first line passing through an axis of the angled portion 15, and a second line passing through an axis of the foot bar, as shown in FIG. 5.

In other implementations, the angle can be set to other angles such as 25 degrees, 30 degrees, 43 degrees, 45 degrees, 60 degrees, 65 degrees, 75 degrees, 85 degrees, 90 degrees, or other angles. The angle can be any desired angle in a range from greater than 0 to less than about 180 degrees. The specifically degrees given can be approximate and angles to be about the values given, such plus or minus 5 degrees.

Figure 7A:
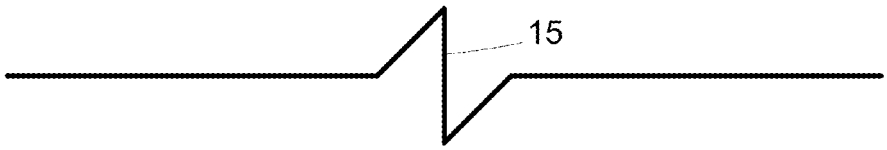
FIGS. 7A-7D show top views of stirrups having differently angled top bars.
Figure 7B:
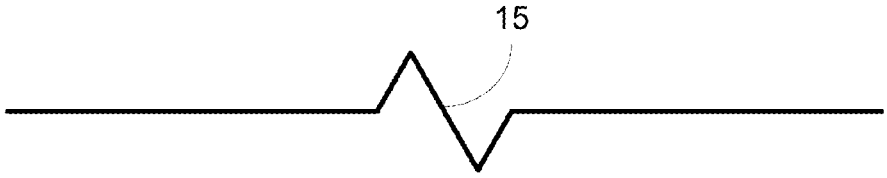
Figure 7C:
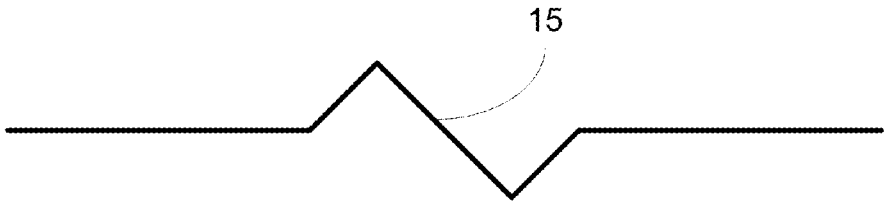
Figure 7D:
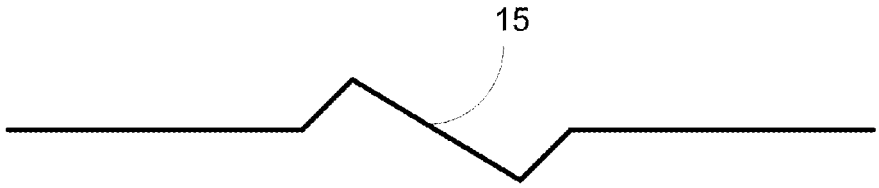

FIGS. 7A-7D show top views of some examples of various angled top bars. FIG. 7A shows an angled portion 15 with a 90 degree offset relative to the foot bar. FIG. 7B shows an angled portion 15 with a 60 degree offset relative to the foot bar. FIG. 7C shows an angled portion 15 with a 45 degree offset relative to the foot bar. FIG. 7D shows an angled portion 15 with a 30 degree offset relative to the foot bar.

Although some specific angle offsets are given, the top member can have any angle from 0 degrees to 180 degrees that is desired. For example, other angles can includes 15, 18, 20, 25, 35, 40, 43, 48, 52, 55, 58, 70, 75, 80, 95, 100, 110, 120, 125, 130, 140, 150, 160, 170, or others.

The middle member and the foot bar are sections that are parallel to each other, so the relative angle can also be measured between lines passing through the angled top member and middle member. The top bar includes angled portion 15, which is angled with respect to the foot bar (and also the middle member). This angled portion creates a relative angle between the foot bar and the strap which holds the stirrup to the saddle. By angling the top bar, this permits the stirrup to hang at the end of the stirrup leather in an orientation, not parallel to the horse, that meets more the rider's riding style needs, comfort needs, and a certain amount of safety.

Figures 8A, 8B, 8C, 8D:
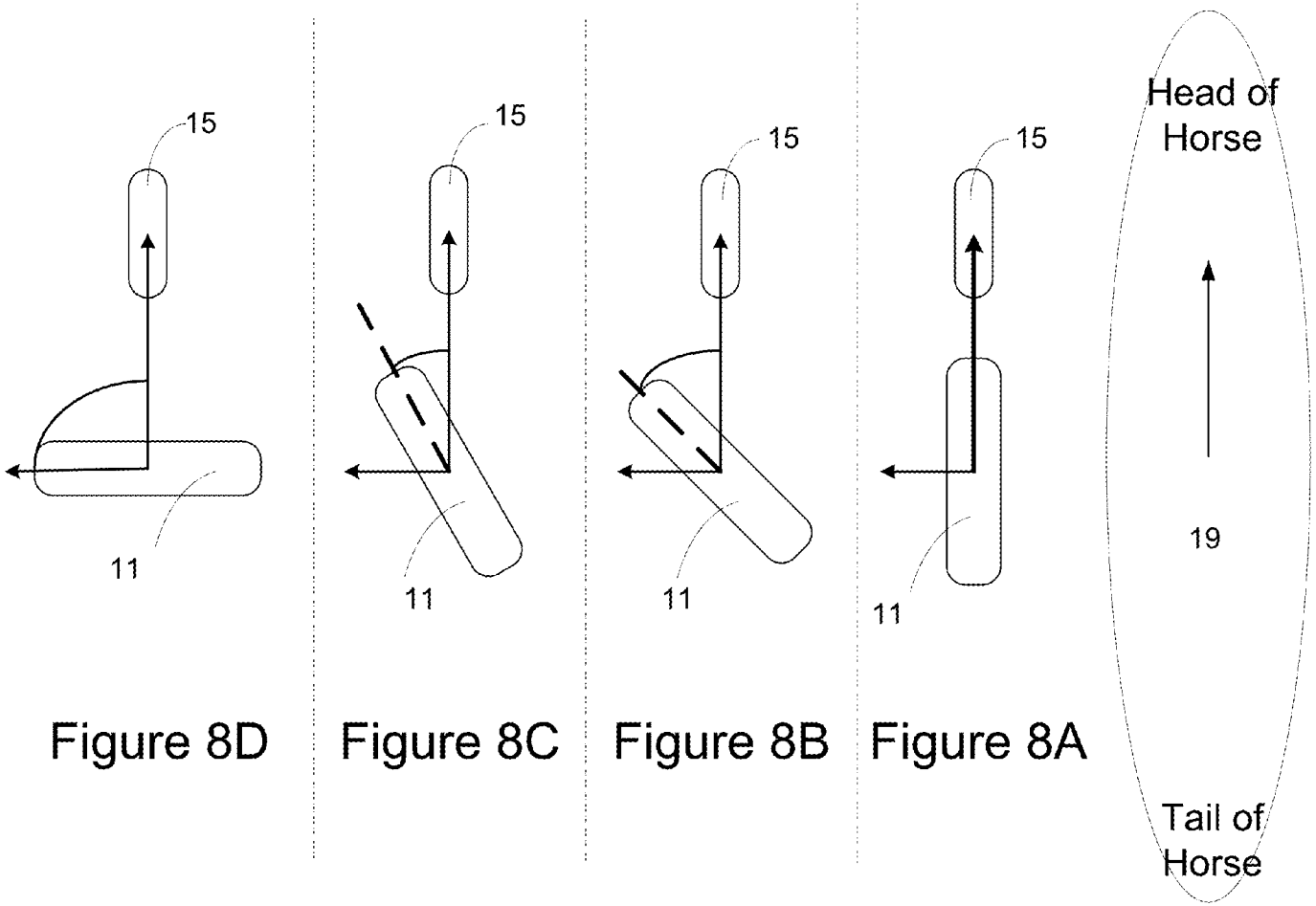
FIGS. 8A-8D shows top views of the angle offsets between the angled portion of the top members and the bottom members or foot bars.

FIGS. 8A-8D show top views of various angle offsets for the foot bar when the angled portion is used with the stirrup leather of a saddle of a horse 19. In FIG. 8A, the angled portion 15 is parallel to the foot bar. Then the foot bar will hang parallel or roughly parallel to a side of the horse. In FIG. 8B, the angled portion 15 is angled 60 degrees relative to the foot bar. Then the foot bar will hang about 60 degrees with respect to the side the horse. In FIG. 8C, the angled portion 15 is angled 45 degrees to the foot bar. Then the foot bar will hang about 45 degrees with respect to the side the horse. In FIG. 8D, the angled portion 15 is angled 30 degrees to the foot bar. Then the foot bar will hang about 30 degrees with respect to the side the horse.

Figure 9:
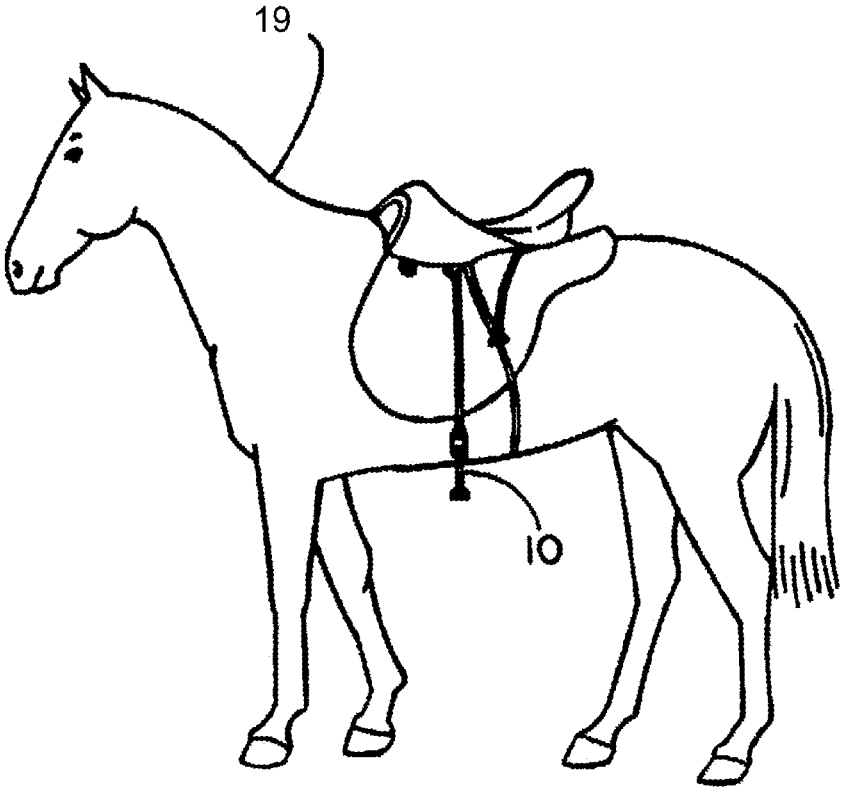
FIG. 9 shows a view of a design of a stirrup that hangs at an angled orientation (not parallel) to the horse.

For an angled portion with a 90 degree offset from the foot bar, the foot bar will be angled 90 degrees with respect to the strap. For example, see FIG. 9 showing the stirrup with an angled top bar forming a 90 degree angle offset between the angled portion 16 and the foot bar 11. The foot bar 11 is perpendicular to the strap.

The equestrian stirrup has a middle member that is coupled to the top and foot bar members, and the middle member is between the top and foot bar members. A stirrup leather opening is between the top and middle members. The second portion of the top member of the stirrup is angled at the first angle relative to the middle member.

Figure 10:
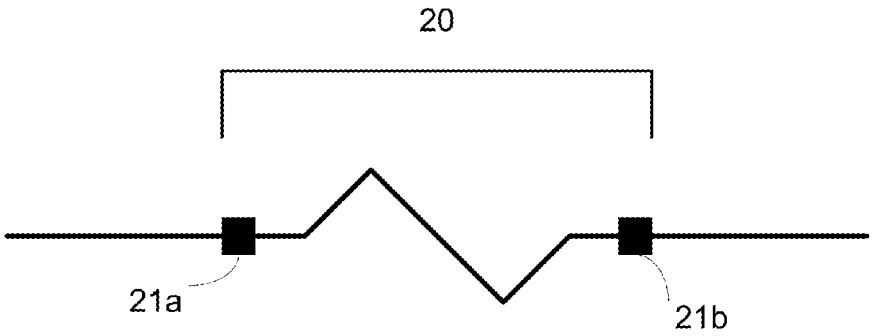
FIG. 10 shows a top view of a stirrup with a detachable top member component.

FIG. 10 shows a top bar of another implementation of a stirrup with an angled top bar. In this implementation, the angled portion of the top bar is removable and replaceable (e.g., detachable). The stirrup includes a top member, middle member, and a foot bar member. The top, middle, and foot bar members are coupled together. The top member includes a first removable section that is capable of being coupled to the top member of the equestrian stirrup and is angled relative to the middle member at a first angle. A second removable section, capable of being coupled to the top member of the equestrian stirrup, is angled relative to the middle member at a second angle, different from the first angle.

The top bar or top member can be removed and replaced by using fittings 21*a* and 21*b*. A first top bar can be replaced with another top bar (e.g., a second top bar) having a different angle from the first top bar. Or a damaged top bar can be replaced with an undamaged top bar. The fittings to connect the top bar can be a screw, pin, bolt, clamp, clasp, clip, latch barrel clasp, screw clasp, and many others.

Figure 11:
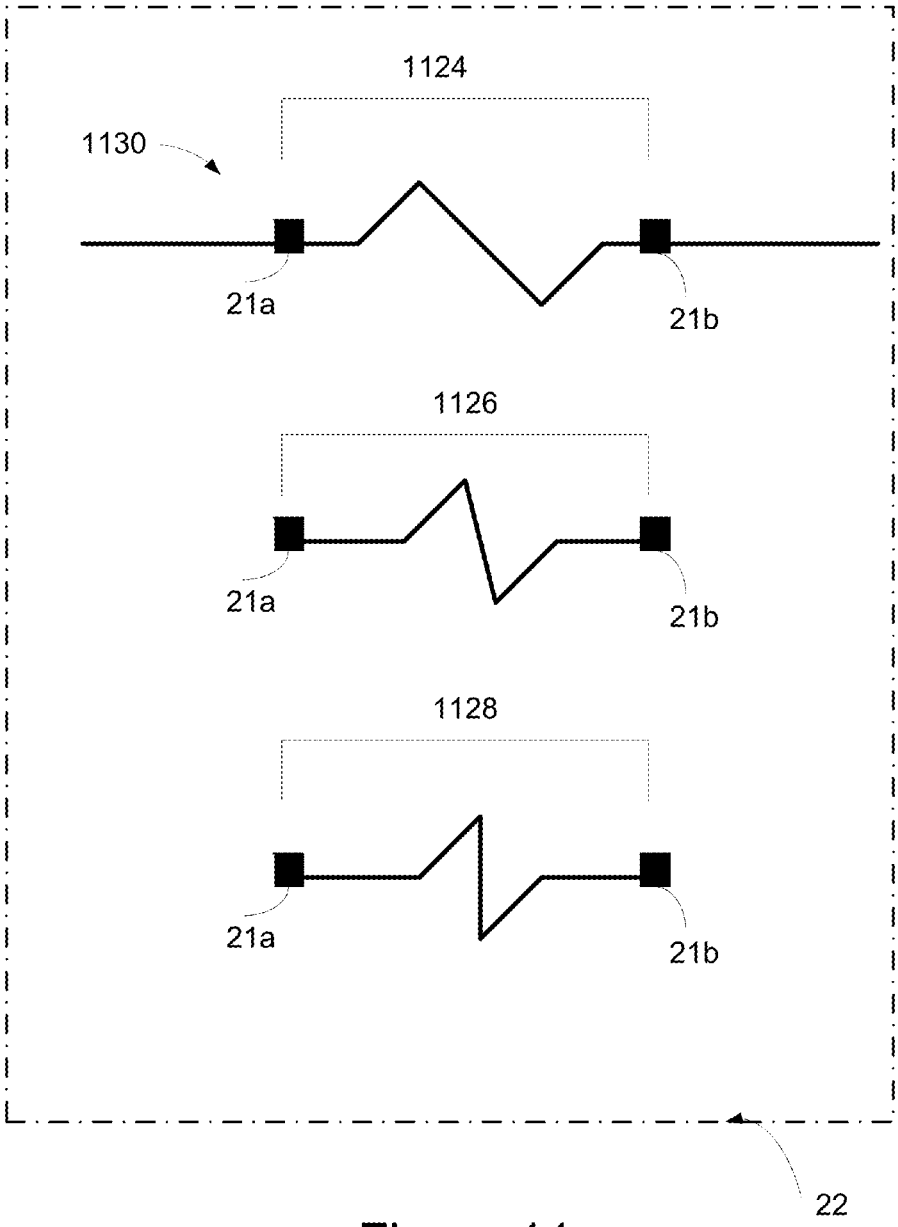
FIG. 11 shows a stirrup kit that includes interchangeable top members.
Figure 12:
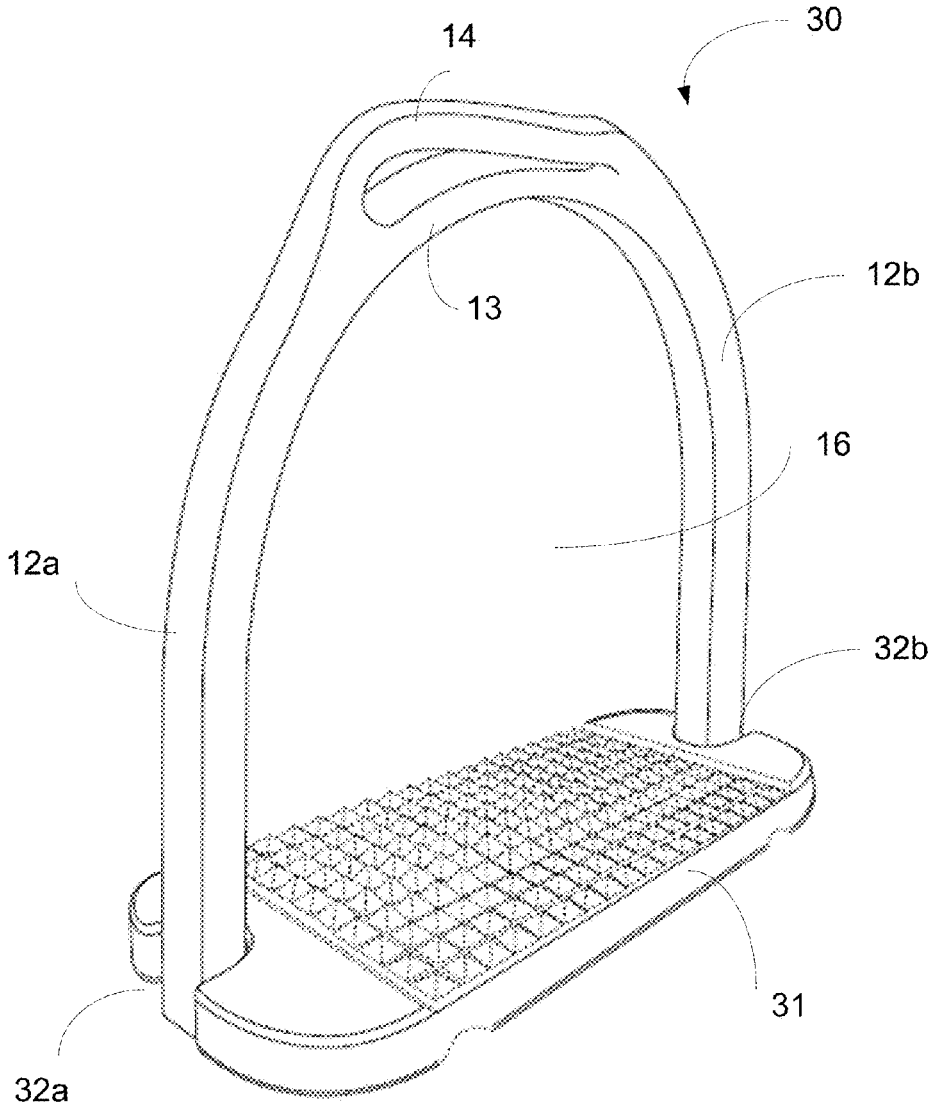
FIG. 12 shows perspective view of a stirrup with a foot pad.
Figure 13:
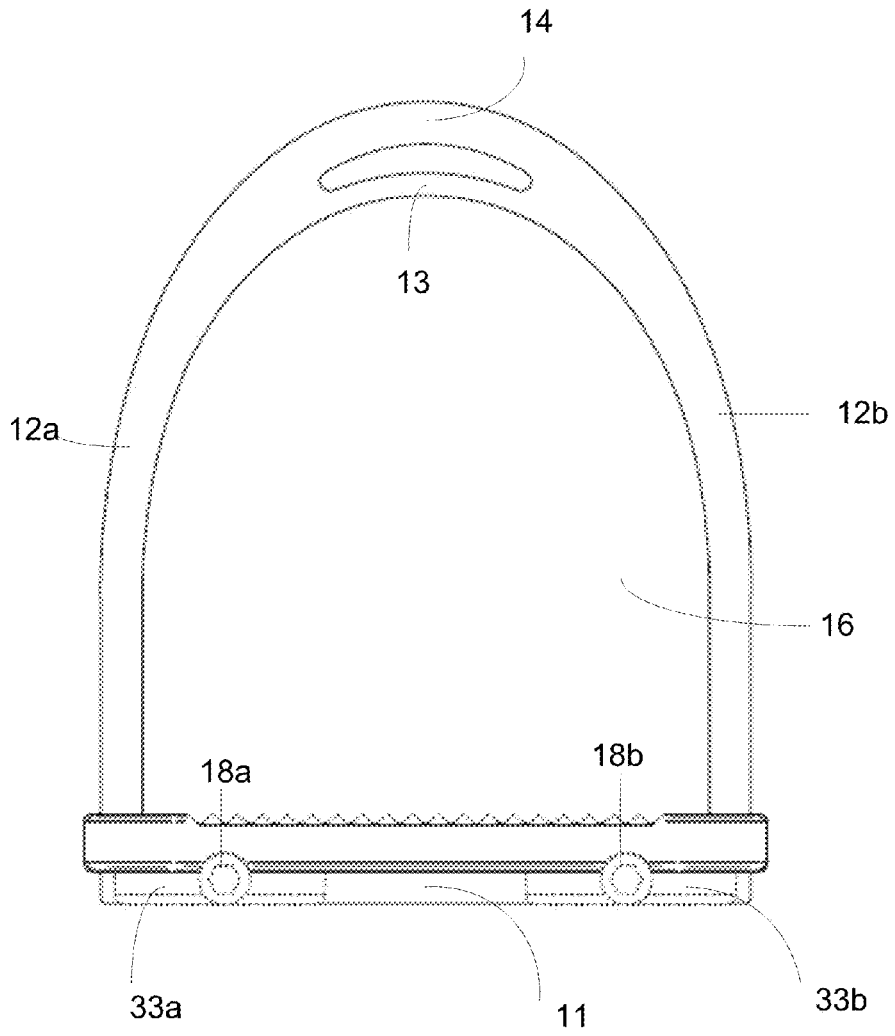
FIG. 13 shows a front view of FIG. 12.
Figure 14:
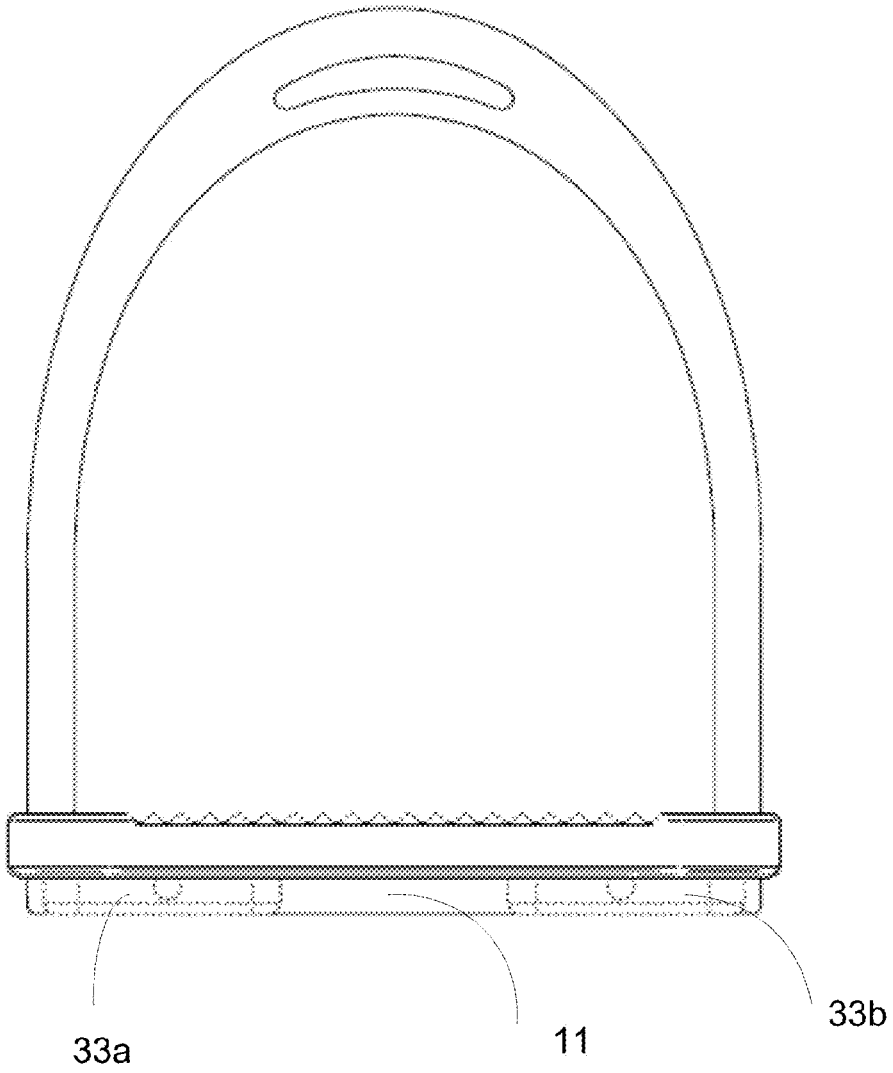
FIG. 14 shows a back view of FIG. 12.

The adjustable stirrup of FIG. 10 can be included in a kit including a number of interchangeable top bars having various angles. FIG. 11 shows the stirrup kit 22 including top bars 1124, 1126, 1128, and a stirrup iron 1130. In the kit, a first top bar 1124 has a 45 angle. A second top bar 1126 has a 75 angle. A third top bar 1128 has a 90 angle. These top bars 1126 and 1128 can be used in place of top bar 1124 in stirrup 1130, such as to change the angle of the stirrup.

Although the stirrup kit 22 described includes some specific angles, a kit may include different angles than those specifically mentioned. These different angled top bars can replace the top bars with angles discussed above, or be in addition to those top bars. Further, the top bar angles included in the kit typically are different from each other, but in some implementation, there may be some duplicate angles.

The kit is includes a package (e.g., box or bag) including the stirrup iron (e.g. the stirrup iron 10 described in FIGS. 1-5 or the stirrup iron described in FIG. 10) and alternative top bars. The package can include any number of top bar angles, including the various angles described above in the application. Within the kit packaging, there can be a holder (e.g., clips, foam receptacle, or foam inserts) to hold each of the bars in the kit, so they do not hit or rattle against each together when being transported. A box of the kit can be translucent or clear, so that the stirrup iron and alternative angles are visible without opening a lid of the box.

The kit shown in FIG. 11 is for a single stirrup iron. Stirrup iron can be sold in pairs. Then the kit will include two stirrup irons, and two of each of the additional angled top bar. Further, other kits can include two or more stirrup irons, such as 3, 4, 5, 6, 7, and 8, or more.

FIGS. 12-17 show an implementation of a stirrup iron 30 which includes stirrup iron 10 and a foot pad 31. The foot pad is positioned on foot bar 11 and is attached to the foot bar by bolts 18*a* and 18*b*. A top surface of the foot pad is textured. On either side (narrow sides) of the foot pad, there are notches 32*a* and 32*b*, where the side members 12*a* and 12*b* of the stirrup iron fit through. The sides members, inserted through the notches, help hold the foot pad in place on the foot bar.

The foot pad 31 is coupled to the foot bar 11. A top surface of the foot pad faces the middle member and the top surface of the foot pad is textured. Opposite ends of the foot pad 30 are coupled to side members 12*a* and 12*b* of stirrup iron 30. The bottom of the foot pad is coupled to a foot bar 11 of stirrup iron via holes 18*a* and 18*b* using a bolt or other fastener.

Figure 15:
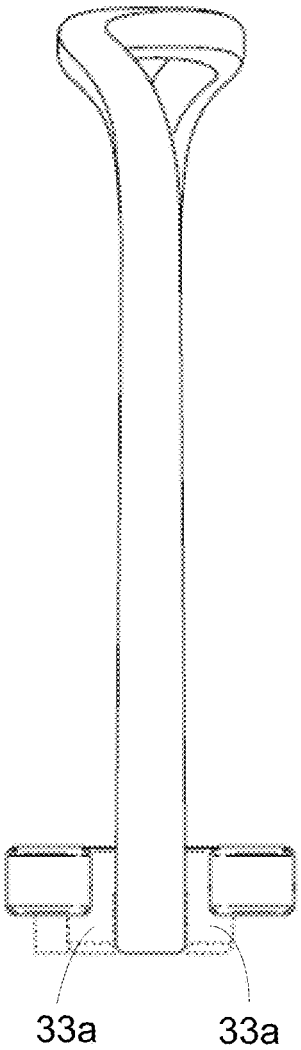
FIG. 15 shows a right-side view of FIG. 12.
Figure 16:
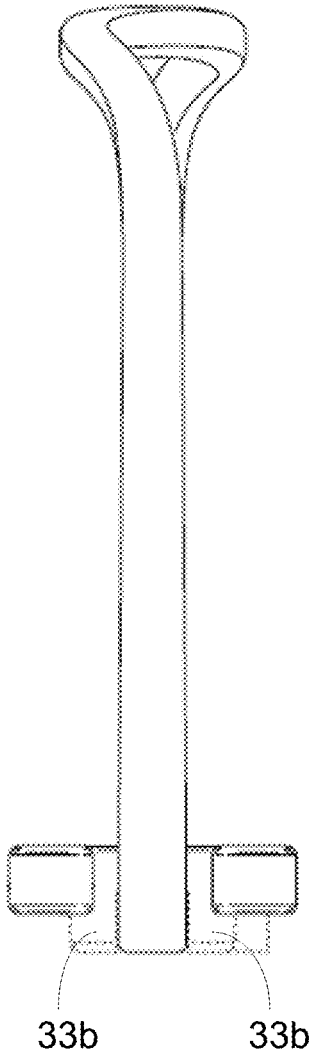
FIG. 16 shows a left-side view of FIG. 12.
Figure 17:
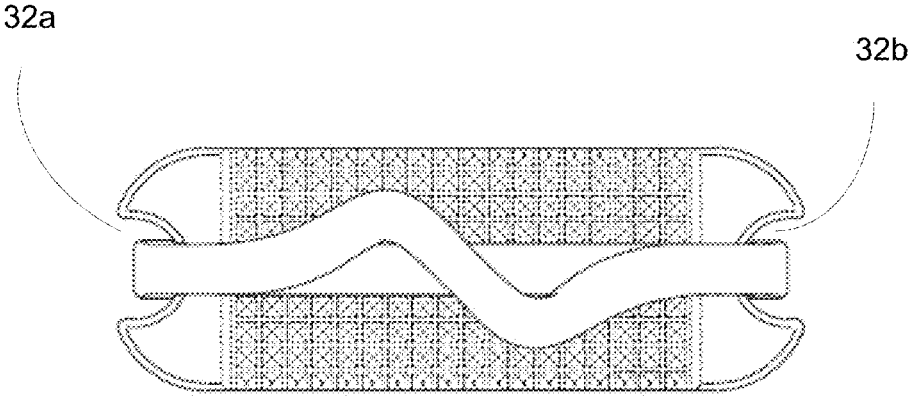
FIG. 17 shows a top view of FIG. 12.
Figure 18:
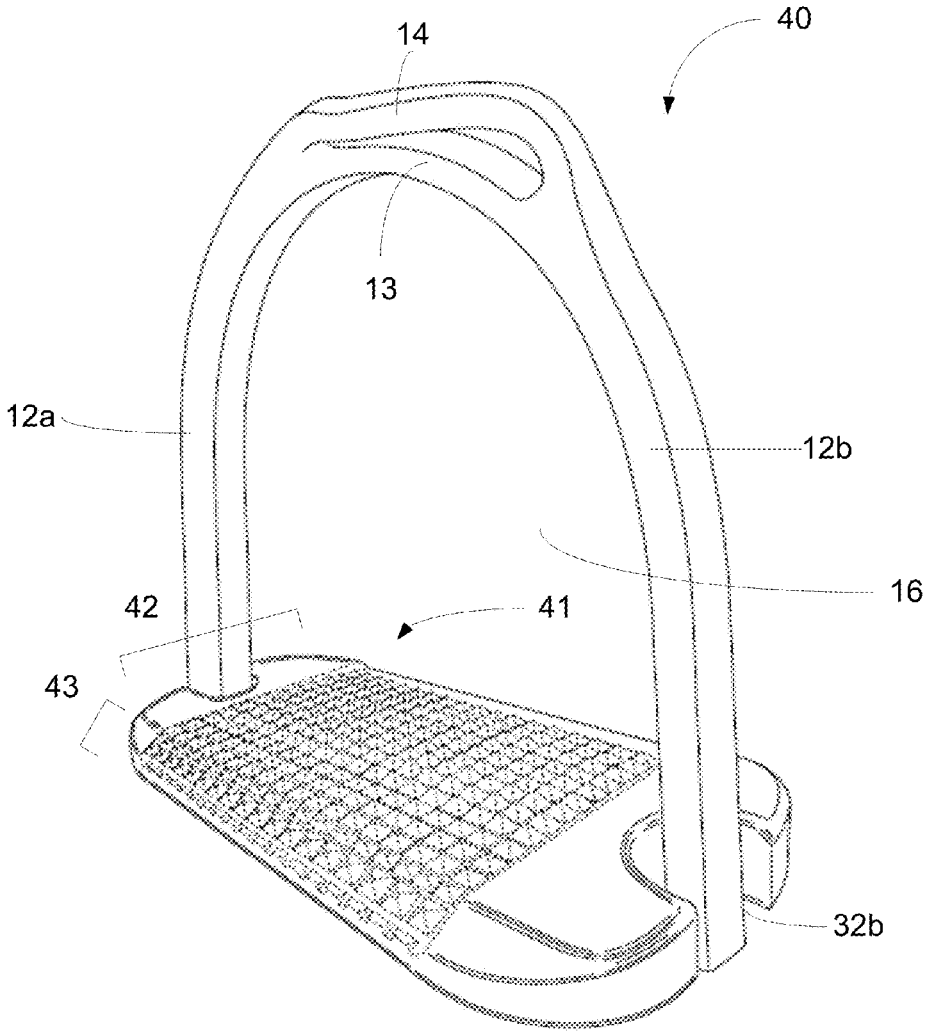
FIG. 18 shows a perspective view of a stirrup with an angled foot pad.
Figure 19:
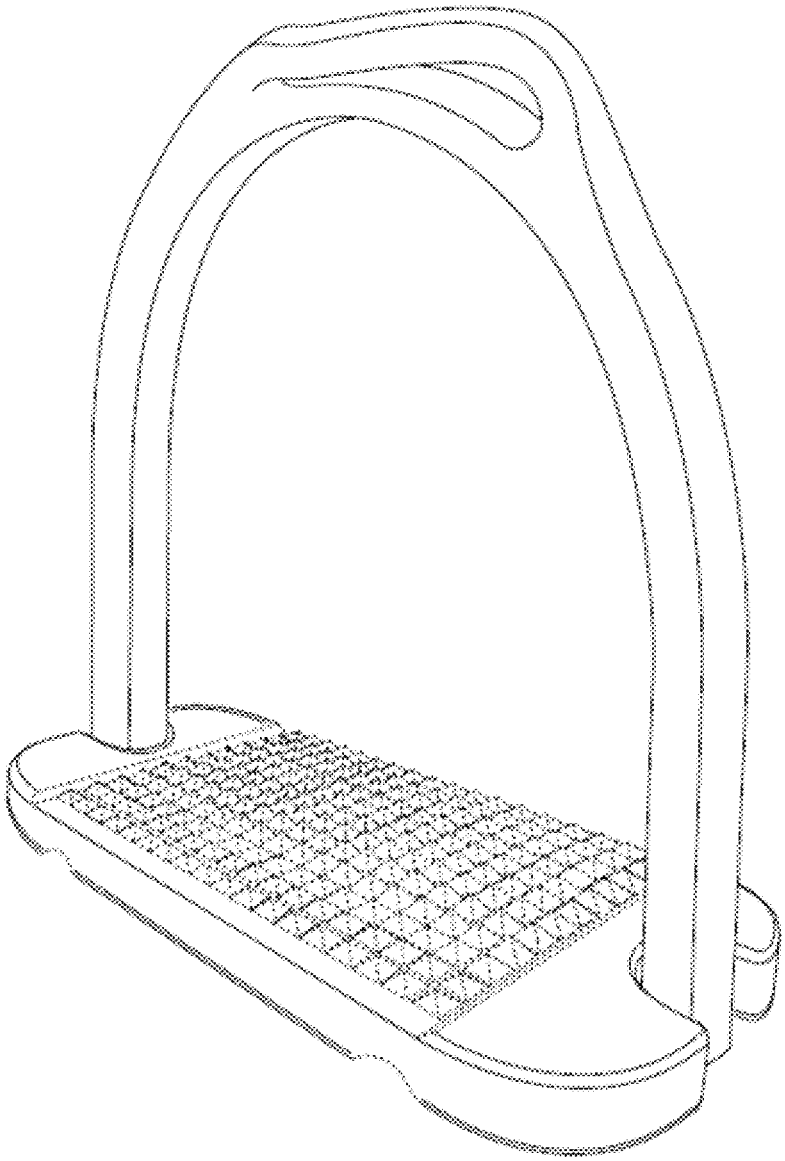
FIG. 19 shows another perspective view of FIG. 18.
Figure 20:
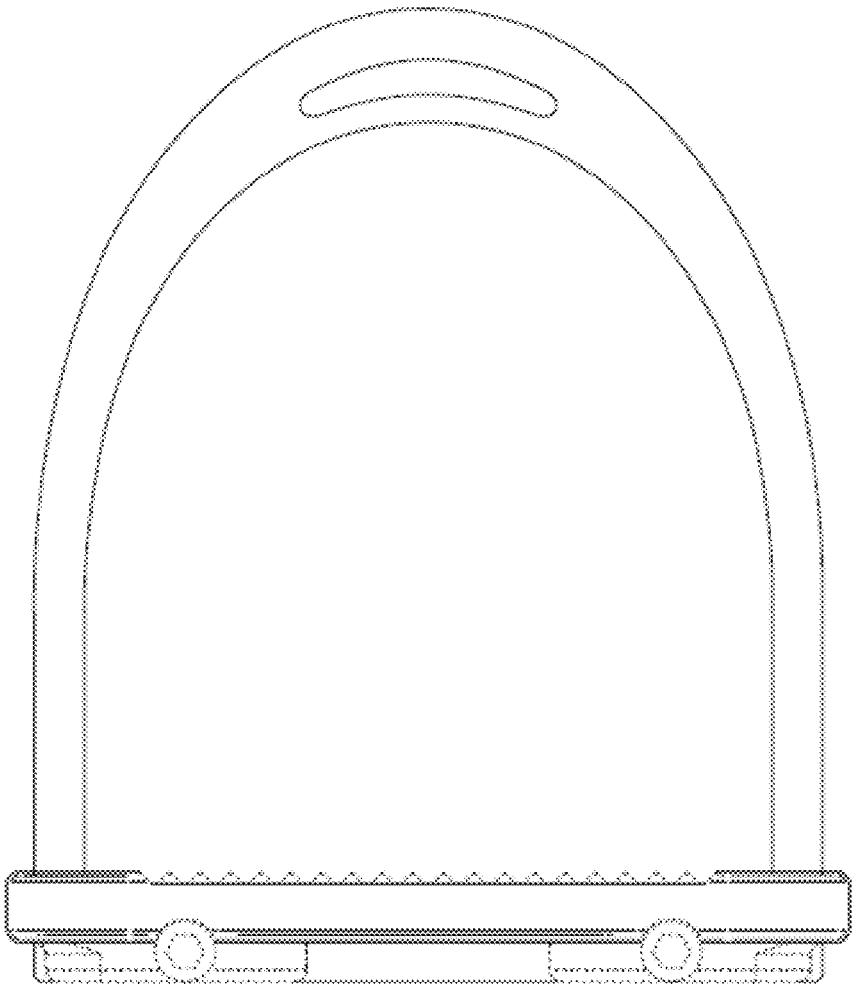
FIG. 20 shows a front view of FIG. 18.
Figure 21:
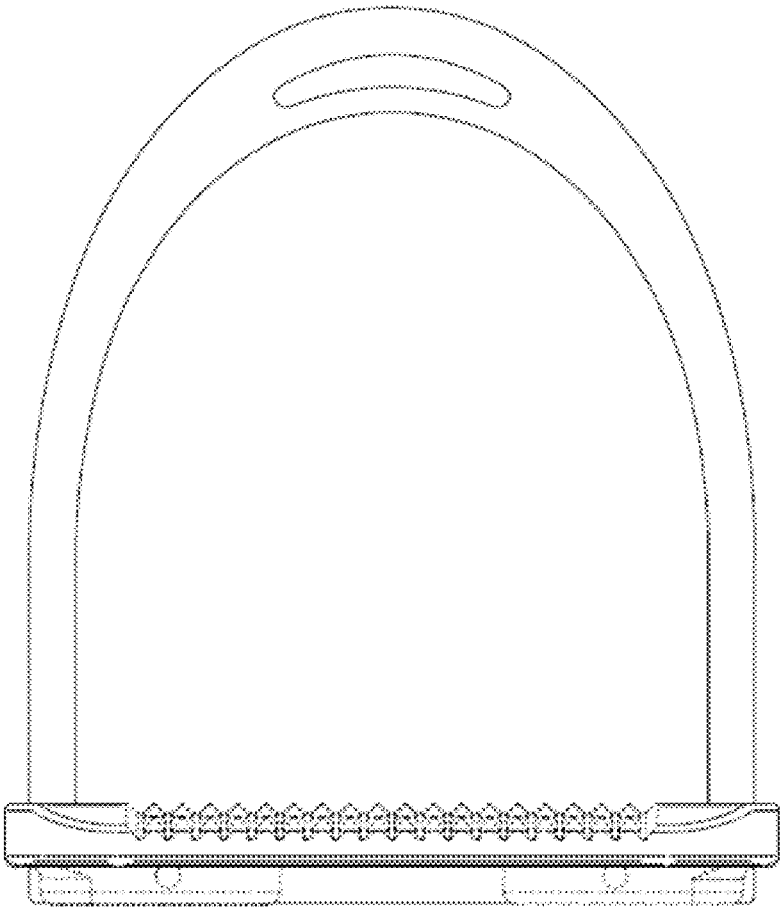
FIG. 21 shows a back view of FIG. 18.
Figure 22:
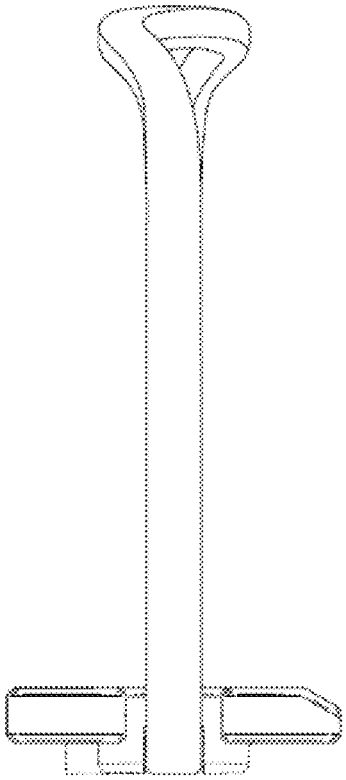
FIG. 22 shows a right-side view of FIG. 18.
Figure 23:
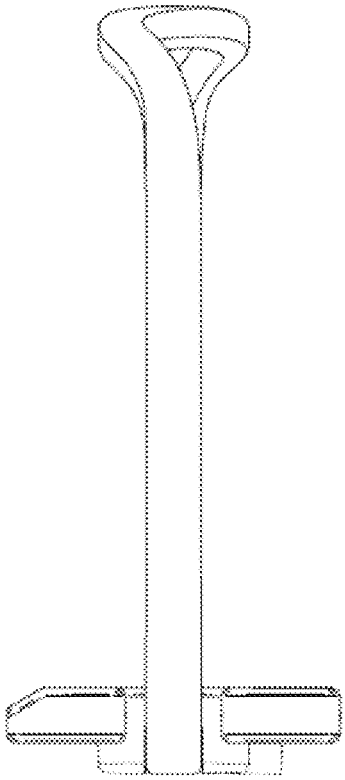
FIG. 23 shows a left-side view of FIG. 18.
Figure 24:
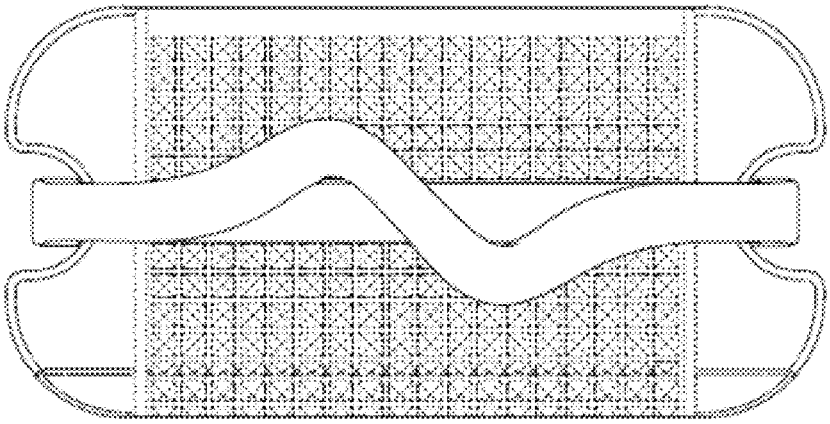
FIG. 24 shows a top view of FIG. 18.
Figure 25:
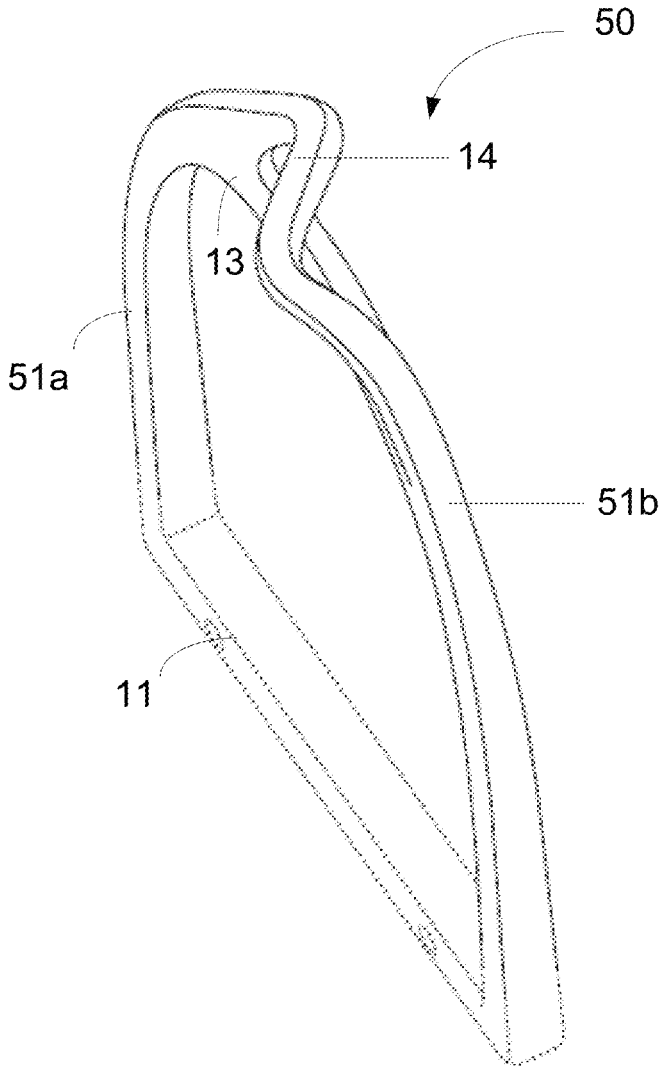
FIG. 25 shows a perspective view of a stirrup with side members having more pronounced tapering than the side members in the FIGS. 1-5.
Figure 26:
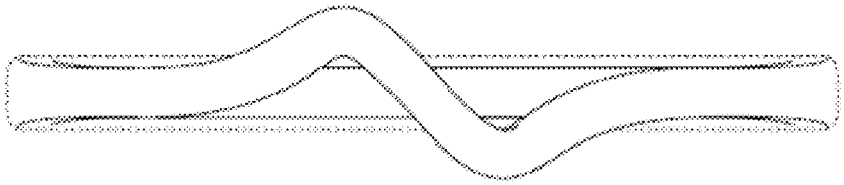
FIG. 26 shows a top view of FIG. 25.
Figure 27:
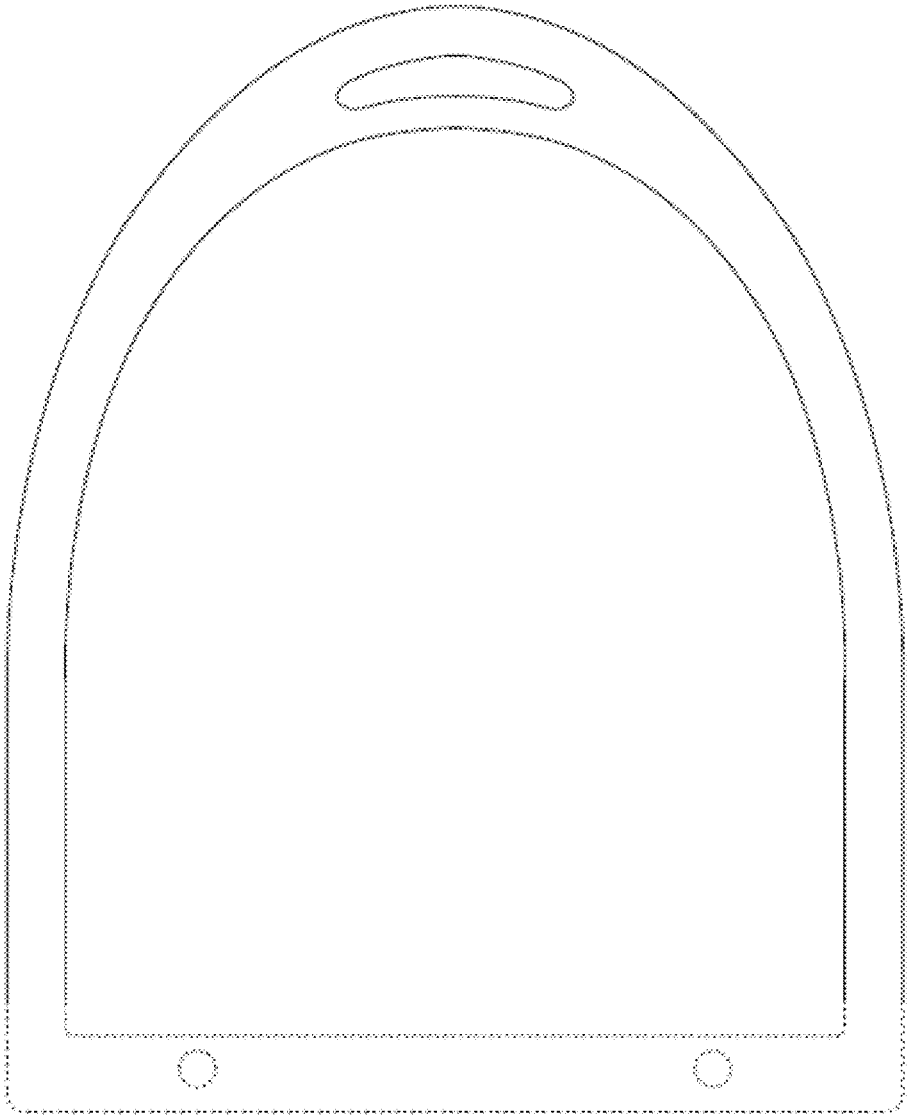
FIG. 27 shows a front view of FIG. 24. A back view appears the same as the front view.

The foot pad 31 has portions 33*a* and 33*b* (e.g., left and right) that extend below a bottom of the foot bad. These portions have an opening through them, which bolts 33*a* and 33*b* can fit through to hold the foot pad to the foot bar. As shown in FIGS. 15 and 16, portions 33*a* and 33*b* can have front and back portions that partially surround foot bar 11.

The bottom of the foot pad can also have depressions rather than having portions that extend below a bottom of the foot pad. The depressions could be sized to fit in foot bar 11, thereby positioning the foot pad 31 firmly in position to the stirrup iron 30.

A top side of the foot pad has a textured surface. The textured portion on the surface of the foot pad increases the grip between the rider's foot and the surface of the foot pad. The textured portion can be treads, grooves, or slits across the surface of the foot pad.

In an implementation, the foot pad is generally rectangular with a length of about 13.8 centimeters and width of 4.8 centimeters. In other implementations, the length and width of the foot pad can be made larger or smaller according to comfort of the rider. The foot pad provides a wider platform for the rider's foot to rest upon comfortably. In other embodiments, the foot pad can also have a circular, elliptical, triangular, pentagonal, or any polygon shape.

FIGS. 18-24 show an implementation of the improved stirrup iron 40 with an angled foot pad 41. The angled foot pad 41 is similar to the foot pad 31 described above. It is a foot pad that is coupled to the foot bar. The first portion 42 and second portion 43 of a top surface of the foot pad 41 are textured. The first portion 42 faces the middle member. The second portion 43 is angled relative to the first portion 42.

This implementation of the improved stirrup iron 40 has a foot pad with a length of 13.8 centimeters and a width of 4.8 centimeters.

In use, the angled edge forms a lip to a foot opening 16 that allows the rider's foot to slip into the stirrup iron easily. It also provides a wider platform for the rider's foot to rest upon comfortably.

Figure 28:
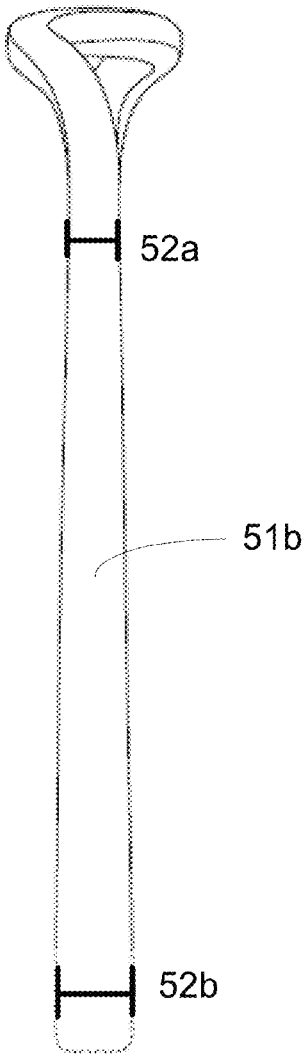
FIG. 28 shows a right-side view of FIG. 25. A left-side view appears the same as the right-side view.
Figure 29:
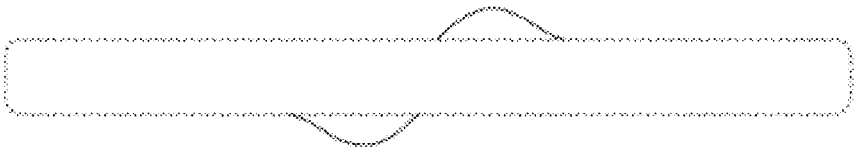
FIG. 29 shows a bottom view of FIG. 25.
Figure 30:
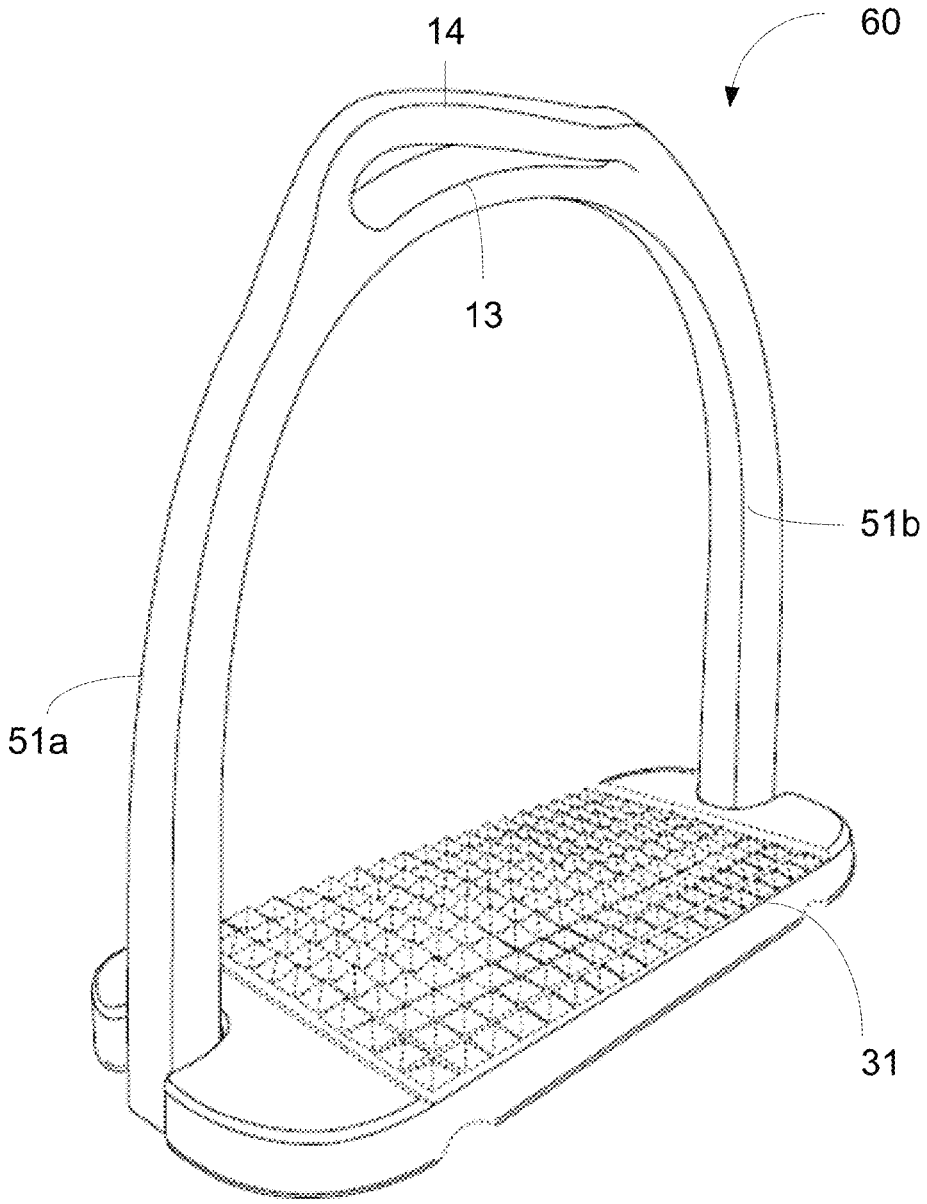
FIG. 30 shows a perspective view of a stirrup with a foot pad and tapered side members (as in FIGS. 25-30).
Figure 31:
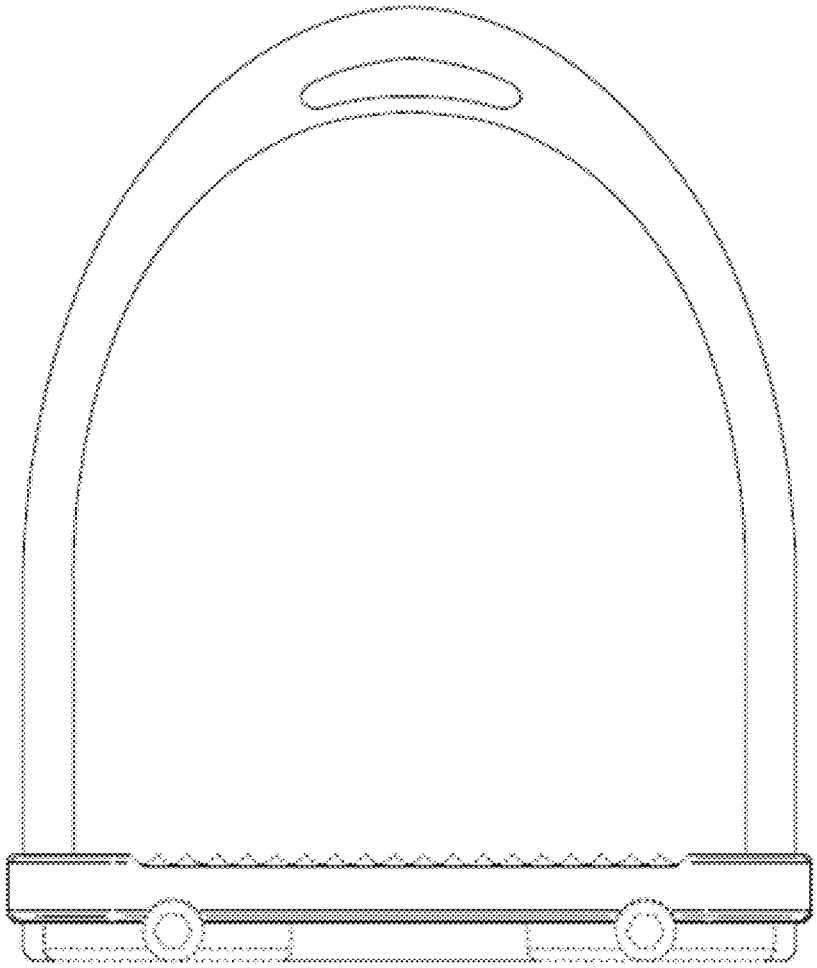
FIG. 31 shows a front view of FIG. 29.
Figure 32:
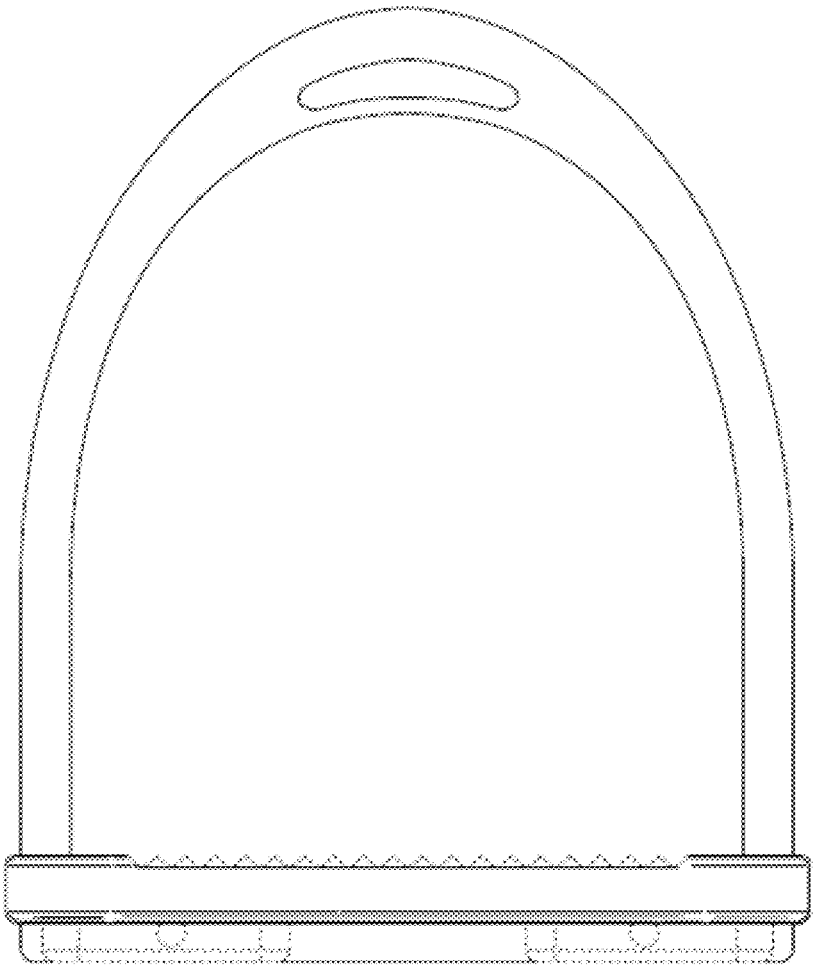
FIG. 32 shows a back view of FIG. 29.
Figure 33:
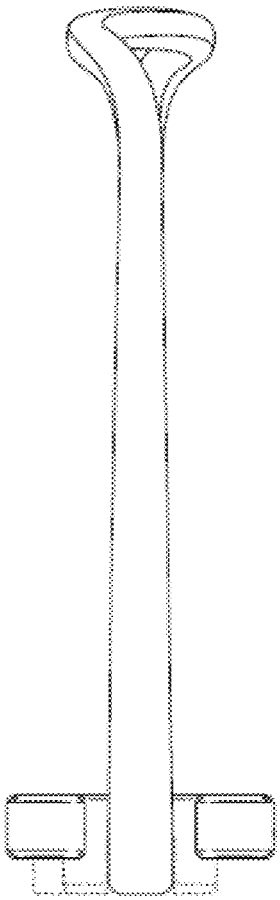
FIG. 33 shows a right-side view of FIG. 29.
Figure 34:
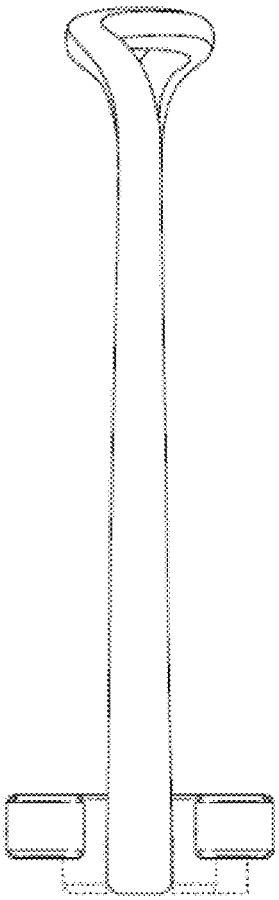
FIG. 34 shows a left-side view of FIG. 29.
Figure 35:
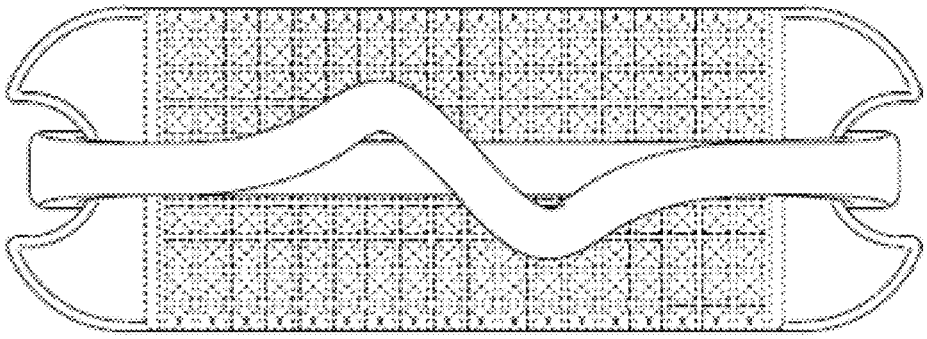
FIG. 35 shows a top view of FIG. 29.
Figure 36:
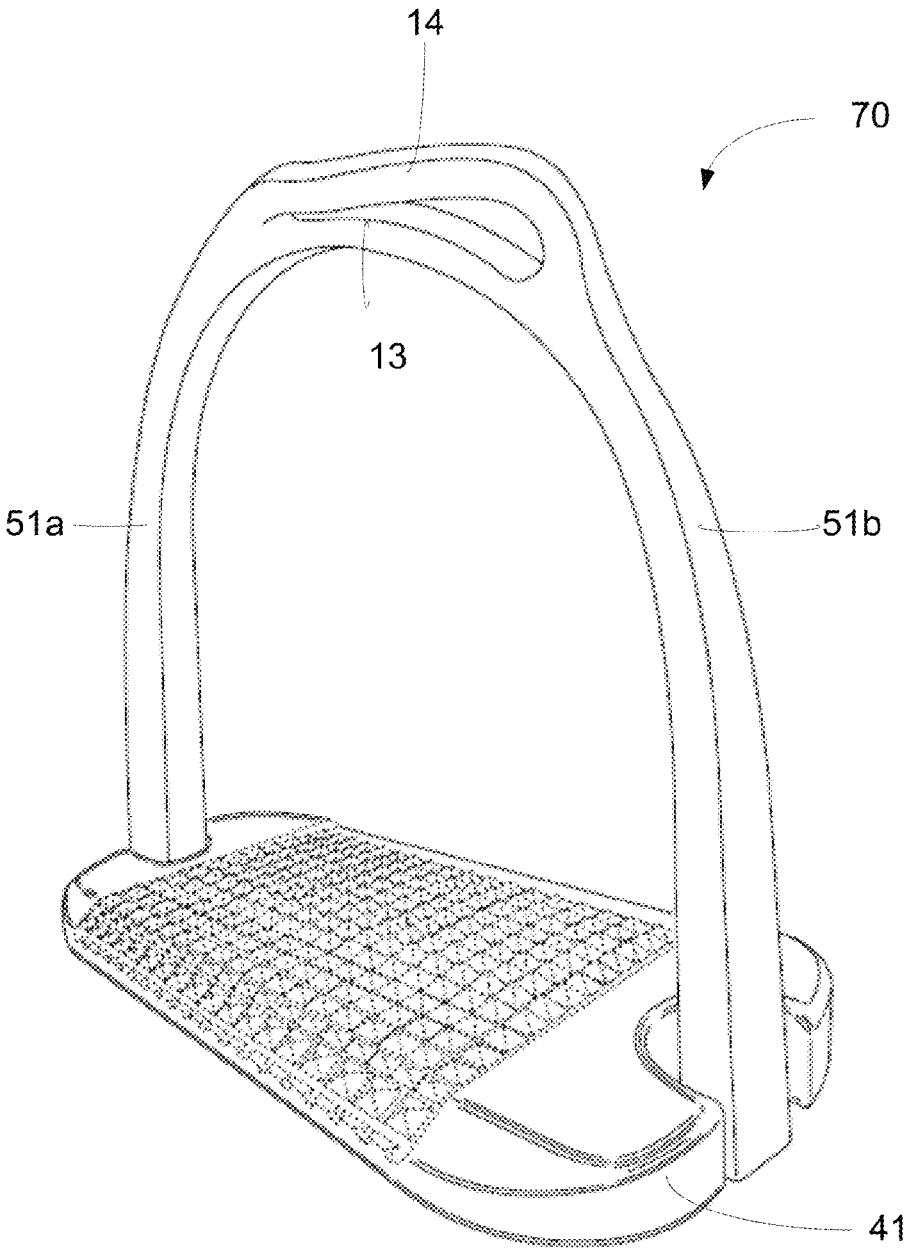
FIG. 36 shows a stirrup with an angled foot pad and tapered side members (as in FIGS. 25-30).
Figure 37:
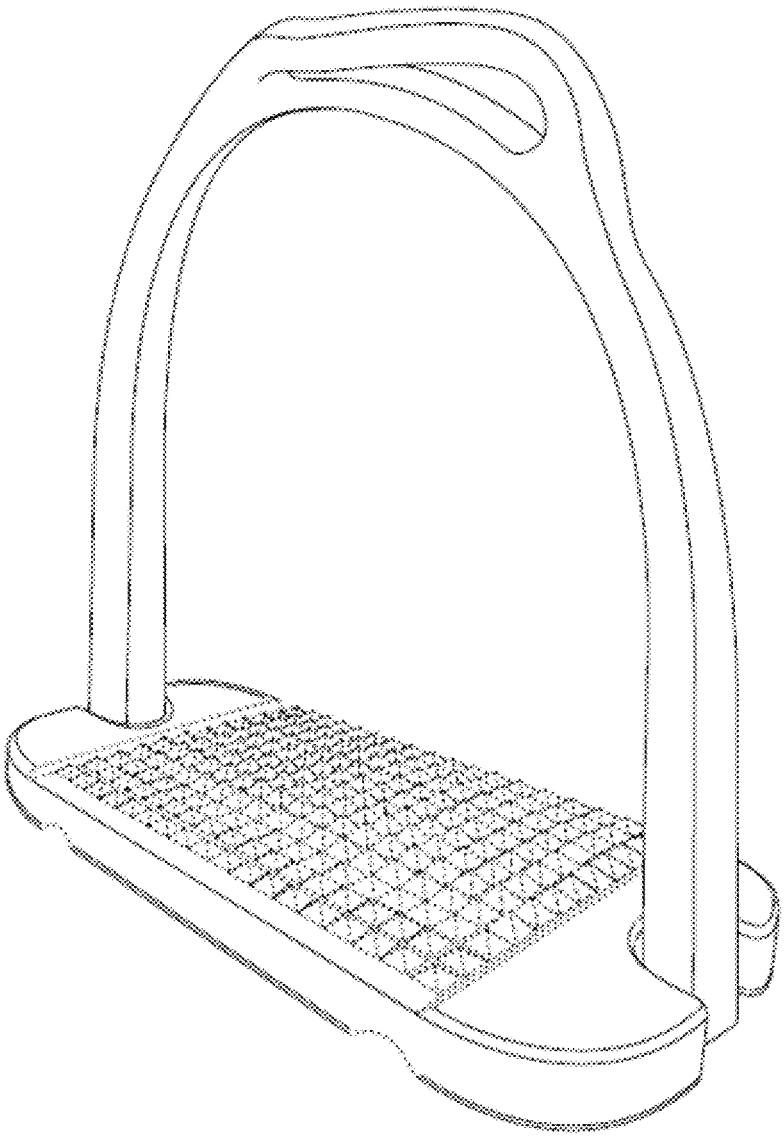
FIG. 37 shows another perspective view of FIG. 36.
Figure 38:
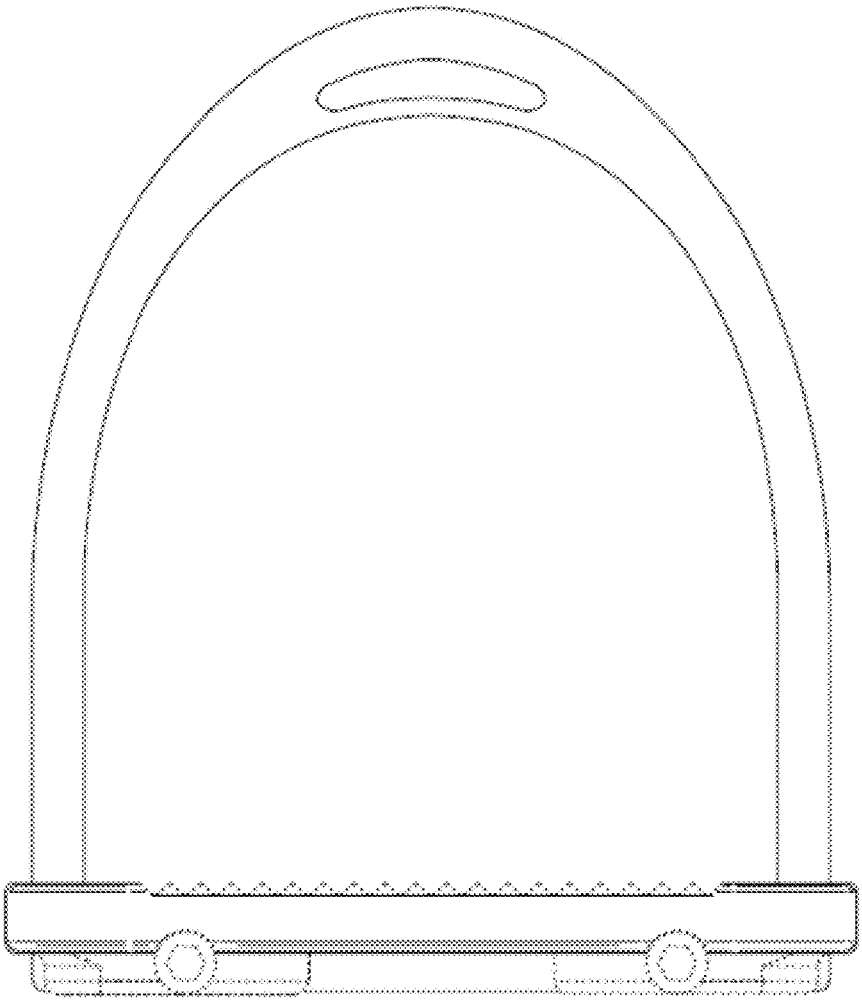
FIG. 38 shows a front view of FIG. 36.
Figure 39:
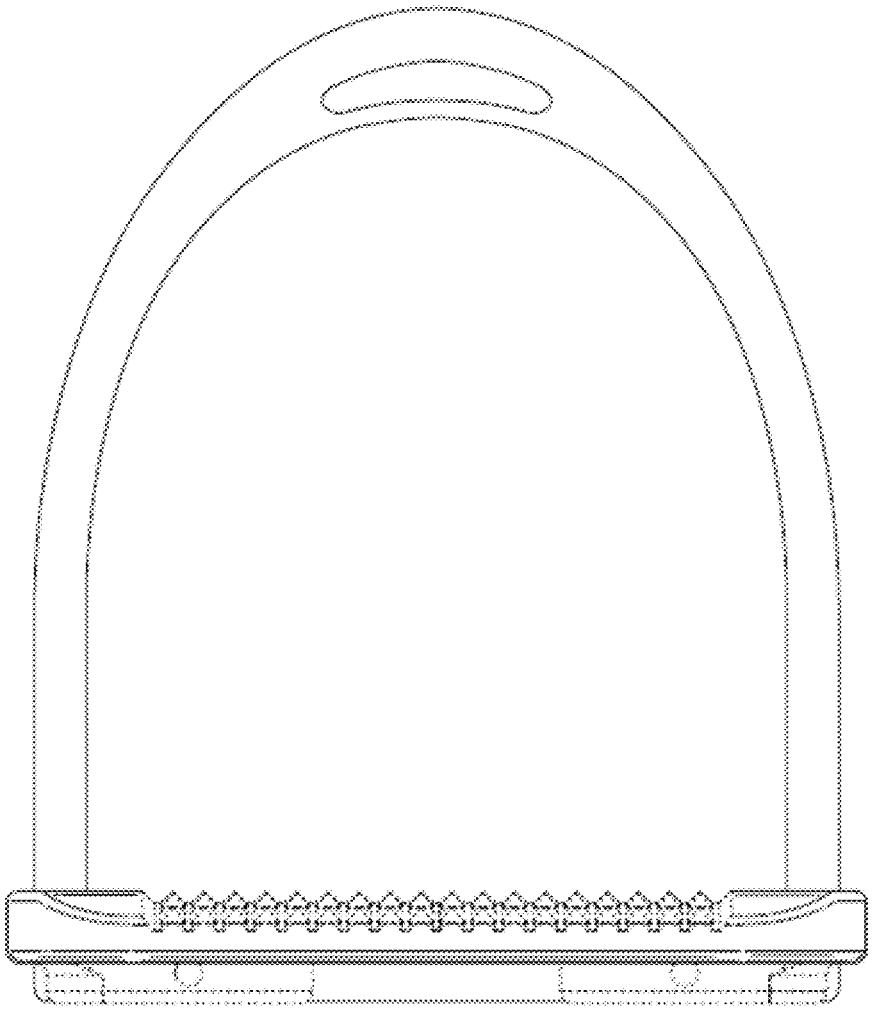
FIG. 39 shows a back view of FIG. 36.
Figure 40:
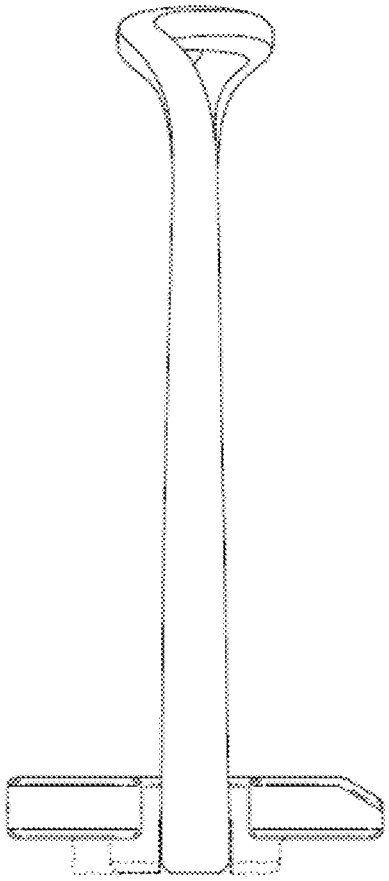
FIG. 40 shows a right-side view of FIG. 36.
Figure 41:
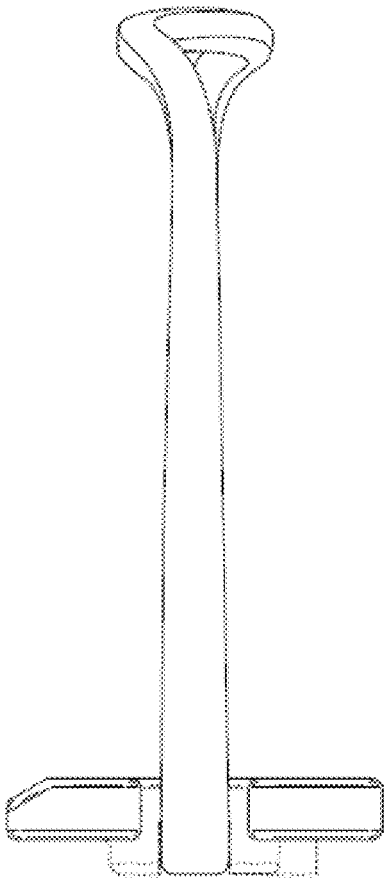
FIG. 41 shows a left-side view of FIG. 36.
Figure 42:
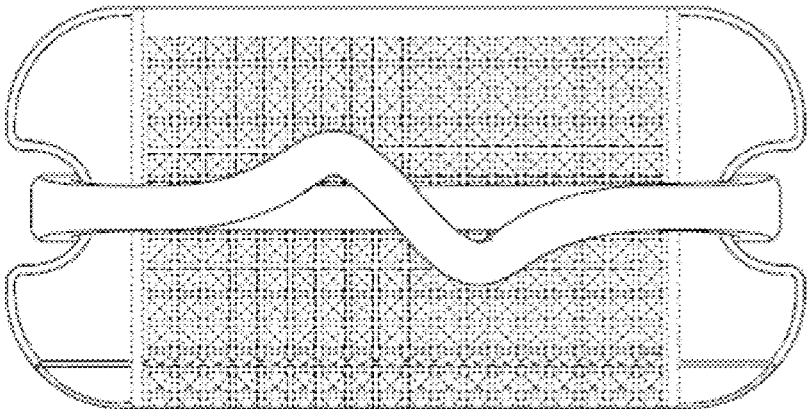
FIG. 42 shows a top view of FIG. 36.

FIGS. 25-29 show an implementation of the improved stirrup iron 50 with tapered side members 51*a* and 51*b*. The tapered side members 51*a* and 51*b* progressively narrows from the end that is coupled to foot bar 11 to the end that is coupled to the middle member 13. So upper width 52*a* of side member 51 is more narrow than lower width 52*b* of side member 51. This implementation is similar to stirrup iron 10 but side members 12*a* and 12*b* have been replaced with tapered side members 51*a* and 51*b*. Side members 12*a* and 12*b* are also tapered, as shown in FIG. 4. However, the tapering in side members 12*a* and 12*b* is not as pronounced as the tapering in tapered side members 51*a*, 51*b*, as shown in FIG. 28. Stirrup iron 50 can also be included in stirrup kit 22.

FIGS. 30-35 show an implementation of the improved stirrup iron 60 that is a combination of foot pad 31 and stirrup iron 50 with tapered side members, 51*a* and 51*b*. Stirrup iron 60 can also be included in stirrup kit 22.

FIGS. 36-42 show an implementation of the improved stirrup iron 70 that is a combination of angled foot pad 41 and stirrup iron 50 with tapered side members, 51*a* and 51*b*. Stirrup iron 70 can also be included in stirrup kit 22.

FIGS. 1-5 also describes a method of providing an equestrian stirrup including a top member 14 and a foot bar member 11, where the top member 14 and foot bar 11 member are coupled together, forming a first portion of the top member of the stirrup to be parallel to the foot bar 11, and forming a second portion of the top member 14 of the stirrup to be angled at a first angle relative to the foot bar 11.

In a specific implementation, the equestrian stirrup may have a middle member that is coupled to the top member 14 and foot bar member 11, and the middle member 13 is between the top 14 and foot bar 11 members. The second portion of the top member 14 of the stirrup is angled at the first angle relative to the middle member 13. The stirrup leather 17 is between the top 14 and middle 13 members.

In another implementation, the top member may have a first removable member. The first removable member can be removably coupled to the top member, and the first removable member includes the second portion of the top member having the first angle. The first angle has a range between about 40 degrees to about 50 degrees.

In another implementation, the top member may also have a second removable member. The second removable member can be removably coupled to the top member, and the second removable member includes a second angle relative to the foot bar that is different form the first angle. The first removable member for the top member can be removed from the stirrup and replaced by the second removable member, thereby altering a riding angle for the stirrup.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. An apparatus comprising:

a first side member and a second side member opposite to the first side member;

a foot bar coupling first ends of the first and second side members together;

a middle member coupling second ends of the first and second side members together, wherein the middle member is opposite to the foot bar, and the middle member is aligned along its entire length with a plane formed by the first and second side members; and a top member coupling opposite ends of the middle member and the second ends of the first and second side members, wherein the middle member is opposite to the foot bar and the middle member is between the top member and the foot bar, the first and second side members, the foot bar, and the middle member define a first opening sufficiently sized to accept a foot, the middle member and the top member define a second opening, smaller than the first opening, sufficiently sized to accept a stirrup leather, and wherein the top member comprises a first bend in a first direction, a second bend in a second direction, opposite to the first direction, a third bend in the first direction, and a fourth bend in the second direction.

2. The apparatus of claim 1 wherein the first bend in the first direction comprises a first angle away from the plane formed by the first and second side members.

3. The apparatus of claim 2 wherein the second bend in the second direction comprises a second angle toward the plane formed by the first and second side members.

4. The apparatus of claim 3 wherein the third bend in the first direction comprises a third angle toward the plane formed by the first and second side members, and the first angle is equal to the third angle, but in opposite directions.

5. The apparatus of claim 4 wherein the fourth bend in the second direction comprises a fourth angle into the plane formed by the first and second side members, and the fourth angle is equal to the first angle, but in opposite directions.

6. The apparatus of claim 5 wherein a segment of the top member, between the second and third bends, passes through the plane formed by the first and second side members.

7. The apparatus of claim 1 wherein the top member comprises a first segment from the first bend to the second bend, a second segment from the second bend to the third bend, and a third segment from the third bend to the fourth bend, a first distance is from the first bend to the fourth bend, a second distance comprises a sum of lengths of the first segment, second segment, and third segment, and the second distance is greater than the first distance.

8. The apparatus of claim 1 wherein an area of the first opening is greater than an area of the second opening.

9. The apparatus of claim 1 comprising:

a foot pad, coupled to the foot bar, wherein a top surface of the foot pad is textured and faces the middle member.

10. The apparatus of claim 1 comprising:

a foot pad, coupled to the foot bar, wherein first and second portions of a top surface of the foot pad are textured, the first portion faces the middle member, and the second portion is angled relative to the first portion.

11. The apparatus of claim 1 wherein a section of the top member, between the second and third bends, is angled relative to the foot bar at about 45 degrees.

12. The apparatus of claim 1 wherein a section of the top member, between the second and third bends, is angled relative to the foot bar at an angle in a range between about 40 degrees to about 50 degrees.

13. The apparatus of claim 1 wherein the middle member extends from the first side member to the second side member without any bends.

14. The apparatus of claim 1 comprising:

a foot pad, coupled to the foot bar, wherein a top surface of the foot pad faces the middle member.

15. The apparatus of claim 1 comprising:

a foot pad, coupled to the foot bar, wherein the foot pad comprises an upper surface comprising first and second portions, the first portion faces the middle member, and the second portion is angled relative to the first portion.

16. The apparatus of claim 1 wherein the first side member comprises:

a first thickness near to the top member, a second thickness near to the foot bar, and the first thickness is less than the second thickness.

17. The apparatus of claim 1 wherein a section of the top member, between the second and third bends is angled relative to the foot bar at about 25 degrees.

18. The apparatus of claim 1 wherein a section of the top member, between the second and third bends is angled relative to the foot bar at an angle in a range between about 15 degrees to about 40 degrees.

19. An apparatus comprising:

a first side member and a second side member, opposite to the first side member;

a foot bar coupling first ends of the first and second side members together;

a middle member, coupling second ends of the first and second side members together, wherein the middle member is opposite to the foot bar, and the middle member is aligned along its entire length with a plane formed by the first and second side members; and a top member, coupling opposite ends of the middle member and the second ends of the first and second side members, wherein the middle member is opposite to the foot bar and the middle member is between the top member and the foot bar, the first and second side members, the foot bar, and the middle member define a first opening, the middle member and the top member define a second opening, smaller than the first opening, and the top member comprises a first bend in a first turn direction, a second bend in a second turn direction, different from the first direction, a third bend in the first direction, and a fourth bend in the second direction.

20. An apparatus comprising:

a first side member and a second side member, opposite to the first side member;

a foot bar coupling first ends of the first and second side members together;

a middle member, coupling second ends of the first and second side members together, wherein the middle member is opposite to the foot bar, and the middle member is aligned along its entire length with a plane formed by the first and second side members; and a top member, coupling opposite ends of the middle member and the second ends of the first and second side members, wherein the middle member is opposite to the foot bar and the middle member is between the top member and the foot bar, the first and second side members, the foot bar, and the middle member define a first opening, the middle member and the top member define a second opening, smaller than the first opening, and the top member comprises a first bend in a first direction, a second bend in a second direction, different from the first direction, a third bend in the first direction, and a fourth bend in the second direction.

* * * * *